United States Patent [19]

Tazima et al.

[11] Patent Number: 4,556,770

[45] Date of Patent: Dec. 3, 1985

[54] INDUCTION HEATING COOKING APPARATUS

[75] Inventors: Yoshihisa Tazima; Masayuki Morishima, both of Kiryu; Hiroshi Okumura; Shin-ichi Kasahara, both of Ashikaga, all of Japan

[73] Assignees: Sanyo Electric Co., Ltd.; Tokyo Sanyo Electric Co., Ltd., both of Japan

[21] Appl. No.: 548,290

[22] Filed: Nov. 3, 1983

Related U.S. Application Data

[62] Division of Ser. No. 163,088, Jun. 26, 1980, Pat. No. 4,438,311.

[30] Foreign Application Priority Data

| | | | |
|---|---|---|---|
| Jul. 5, 1979 | [JP] | Japan | 54-85638 |
| Jul. 5, 1979 | [JP] | Japan | 54-85639 |
| Jul. 5, 1979 | [JP] | Japan | 54-85640 |

[51] Int. Cl.[4] ..... H05B 6/06

[52] U.S. Cl. ..... 219/10.49 R; 219/10.77

[58] Field of Search ..... 219/10.77, 10.49 R, 219/494, 490; 363/20, 21, 55, 56, 96, 97, 80, 131, 135; 323/275, 276, 277; 307/252 L, 252 M, 253

[56] References Cited

U.S. PATENT DOCUMENTS

| | | | |
|---|---|---|---|
| 4,110,588 | 8/1978 | Holz | 219/10.77 X |
| 4,112,287 | 9/1978 | Oates et al. | 219/10.77 X |
| 4,115,676 | 9/1978 | Higuchi et al. | 219/10.49 R |
| 4,145,592 | 3/1979 | Mizukawa et al. | 219/10.77 X |
| 4,275,281 | 6/1981 | Kiuchi | 219/10.77 X |

*Primary Examiner*—Philip H. Leung

*Attorney, Agent, or Firm*—Darby & Darby

[57] ABSTRACT

An induction heating coil and a self-excited inverter are connected to a ripple voltage source. The self-excited inverter comprises a transistor as a switching element and the transistor is rendered conductive responsive to a drive voltage applied for each cycle of the ripple voltage source, whereby the self-excited inverter is started at each cycle of the ripple voltage source. The self-excited inverter stops the oscillation when the voltage of the ripple voltage source becomes lower than a predetermined value. During the non-oscillation period of the intermittent oscillation, the oscillation output of the self-excited inverter is detected. If and when the oscillation output is detected at that time, the oscillation of the inverter is stopped. Furthermore, the pulses of the attenuating oscillation of the self-excited inverter during the oscillation rest period are counted. If and when the count value of the counter is smaller than a predetermined value, the oscillation of the self-excited inverter is started, whereas if and when the count value of the counter exceeds the predetermined value, the oscillation stop state is continued.

20 Claims, 12 Drawing Figures

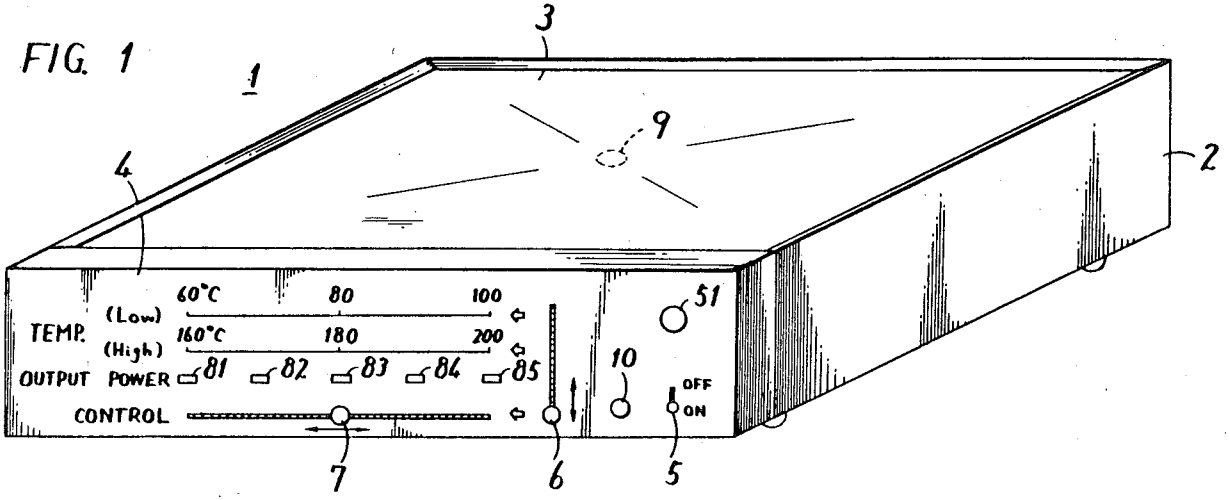
FIG. 1
FIG. 2
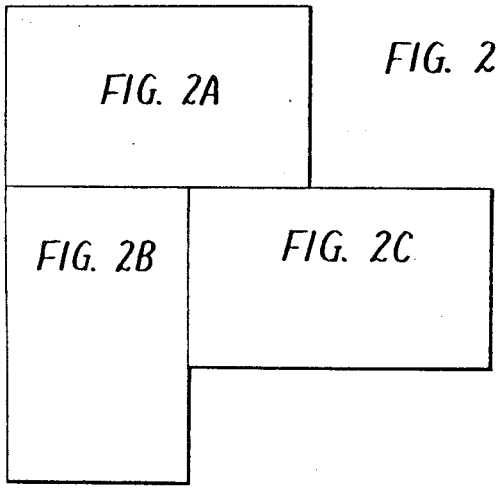

INDUCTION HEATING COOKING APPARATUS

"This is a division of application Ser. No. 163,088, filed June 26, 1980 U.S. Pat. No. 4,438,311.

BACKGROUND OF THE INVENTION

1. Field of the Invention

The present invention relates to an induction heating cooking apparatus. More specifically, the present invention relates to an apparatus for controlling an inverter depending on a load state of a load kind in an induction heating cooking apparatus.

2. Description of the Prior Art

An induction heating apparatus obtains a ripple voltage source by rectifying a commercial alternating current voltage source or further obtains a direct current voltage source by smoothing the ripple current. An inverter circuit is energized by the ripple voltage source or the direct current voltage source, whereby high frequency oscillation is performed with the frequency of approximately 20 to 40 kHz. A high frequency current from the inverter circuit is applied to an induction heating coil, whereby a high frequency alternating magnetic field is generated from the induction heating coil. The alternating magnetic field from the induction heating coil is applied to a load being heated such as a cooking pan disposed in the vicinity of the coil, so that the load is induction heated. As such cooking pan, a pan made of metal including at least iron as the constituent is used. One example of such induction heating cooking apparatus is seen in, for example, U.S. Pat. No. 3,781,503, issued Dec. 25, 1973 to Harnden, Jr. et al. and entitled "SOLID STATE INDUCTION COOKING APPLIANCES AND CIRCUITS"; U.S. Pat. No. 3,781,506 issued Dec. 25, 1973 to Ketchum et al. and entitled "NON-CONTACTING TEMPERATURE MEASUREMENT OF INDUCTIVELY HEATED UTENSIL AND OTHER OBJECTS"; and so on.

Since such induction heating cooking apparatus is not of a type for heating a load being heated using a flame, it is impossible to discern whether the apparatus is in a heating operation only through a look at it. Therefore, there is a fear that a heating operation is started without a load being heated such as a cooking pan being placed on a base or a top plate. There is also a fear that a load smaller than a cooking pan, such as a knife, fork or the like is placed on a top plate, without noticing that the apparatus is already in a heating operation, whereby such small load is undesirably heated. In the former case, it is feared that electrical components of the cooking apparatus are damaged, while electric power is wastefully consumed. On the other hand, in the latter case, there could be a risk that the user touches an undesirably heated knife or the like through inadvertence to get burnt in the hand, which is not much preferred from the standpoint of safety. In order to cope with the above described problems, therefore, it has been conventionally proposed that a magnet is disposed beneath the top plate to detect whether a proper load is placed on the top plate, thereby to enable an induction heating operation only when a proper load is placed. Nevertheless, such a conventional approach of detecting presence or absence of a proper load with a magnet entails another problem that the approach cannot be employed in case of a cooking pan made of a special stainless material which is not attracted by a magnet, although such cooking pan serves as a load of an induction heating cooking apparatus.

SUMMARY OF THE INVENTION

The inventive induction heating cooking apparatus comprises high frequency oscillation means such as an inverter for making high frequency oscillation in an intermittent manner for every predetermined period. An induction heating coil is energized by a high frequency current generated by the intermittent high frequency oscillating means, whereby a high frequency alternating magnetic field is generated. The presence or absence of the output from the oscillating means is detected during the period corresponding to a non-oscillation period of the intermittent oscillation. In the case of no load on a top plate, an oscillation occurs in the non-oscillation period. If and when such oscillation output is detected during the period corresponding to the non-oscillation period, the oscillation of the intermittent high frequency oscillating means is stopped.

According to the present invention, even in the case where the load is removed from the top plate while the load is being heated, such change of the load is detected during the period corresponding to the non-oscillation period of the intermittent oscillation, whereby the high frequency oscillation is stopped thereafter. Accordingly, wasteful consumption of electric power is prevented.

In a further preferred embodiment of the present invention, a counter is provided for detecting the presence/absence of the output of the attenuating oscillation from the oscillating means. The oscillating operation of the intermittent high frequency oscillating means is stopped, if and when the count value of the counter reaches a predetermined value. The count value of the counter exceeds the predetermined value, in the case where no load has been placed on the top plate from the beginning, or in the case where, even if a load has been placed, the load is not suited for heating, as in the case of a knife, fork or the like. Accordingly in the case where a small load such as a knife, a fork or the like as compared with a proper load is placed on the top plate, likewise the output from the high frequency oscillating means is detected during the period corresponding to the non-oscillation period, whereby the oscillation is stopped. As a result, there is no fear that a small load placed on the top plate through inadvertence is undesirably heated. Accordingly, there is no risk that an operator gets burned in the hand with an undesirably heated knife, fork or the like and accordingly the safety of a cooking apparatus is considerably enhanced. Furthermore, in the case of a change from the above described-no-load state or the small load state to a state or a proper load being placed on the top plate, such change is detected at the leading edge of the succeeding period. Accordingly, when such proper load is placed again, a normal heating operation can be performed automatically. More specifically, if and when the count value in the counter is smaller than the predetermined value, it is determined that a proper load has been placed and, insofar as a power supply switch has been turned on, an induction heating operation is performed. According to the preferred embodiment in discussion, only one counter may be employed to detect a load state and/or a load kind and as a result the structure may be more simplified. In such a case, it is not necessary to manually operate a separate switch or the like and as a result an induction heating cooking apparatus of a more improved convenience of operation is provided.

In a preferred embodiment of the present invention, a self-excited inverter is employed as the intermittent high frequency oscillating means. As a switching element of the self-excited inverter, a transistor, a gate turn-off thyristor, or the like of a large break down voltage may be employed. The base electrode of such transistor or the gate electrode of such thyristor is connected to receive a drive voltage from a driver circuit, whereby such transistor or thyristor is driven in a conduction state during the period of the drive voltage. According to such embodiment, as compared with an embodiment employing a silicon controlled rectifier as a switching element, it is not necessary to provide a turn off circuit for a silicon controlled rectifier, with the result that a circuit configuration may be simplified.

In a further preferred embodiment of the present invention, even in the case where a special load having a small resistance value made of a special stainless steel material (18-8) as compared with a normal load is used, the inventive induction heating cooking apparatus functions with safety and without circuit components being damaged. More specifically, in the case where the above described special load is placed on the top plate, an overcurrent flows through the heating coil due to a small resistance value; however, according to the preferred embodiment in discussion, such overcurrent is detected, whereupon the output electric power is forcibly decreased. Therefore, according to the preferred embodiment in discussion, the output electric power is decreased upon detection of an overcurrent when a special load is placed on the top plate, whereby an overcurrent is prevented from flowing thereafter, with the result that the current is limited to substantially a constant value. Accordingly, damage of circuit components of the cooking apparatus due to the above described overcurrent, undesired interruption by a circuit breaker of the commercial power supply and the like are effectively prevented. Furthermore, since such an overcurrent as described above will not flow, a switching element constituting the inverter will not be adversely affected and accordingly such switching element can be of a low current type. In addition, reliability of the cooking apparatus is enhanced and the life thereof can be much more prolonged.

In a further preferred embodiment of the present invention, a start signal is first generated for the purpose of providing the above described drive voltage. A ripple current is used as a voltage source and the start signal is generated at the beginning of each cycle of the ripple current. A monostable multivibrator is provided to be triggered responsive to the start signal. The output pulse of the monostable multivibrator is amplified and the amplified output is used as the above described drive voltage. Accordingly, by changing the duration period of the output of the monostable multivibrator, the time width of the drive voltage and thus the conduction period of the transistor or the gate turn-off thyristor can be controlled. More specifically, if the duration period of the output from the monostable multivibrator is reduced, the initial conduction period of the transistor or the gate turn-off thyristor becomes short and accordingly the oscillation frequency becomes high and the output current or the power is decreased. On the contrary, if the duration period of the output of the monostable multivibrator is increased, the initial conduction period of the transistor or the gate turn-off thyristor becomes long and the oscillation frequency becomes low and as a result the output power is increased. According to the preferred embodiment in discussion, only the time constant of the monostable multivibrator may be controlled in adjusting the output power and accordingly the output power can be adjusted with simplicity.

In still another preferred embodiment of the present invention, the temperature of the load is detected using a heat or temperature sensitive element such as a negative characteristic thermistor. The temperature of the load being heated is controlled using a variation of the resistance of the thermistor. According to the preferred embodiment in discussion, since the temperature of the load being heated is detected by the use of the heat sensitive element such as a thermistor, accurate temperature control can be made without regard to the kinds of the load being heated. The present invention is different in this respect from the above referenced U.S. Pat. No. 3,781,506. More specifically, although temperature control has been made even by the above referenced U.S. Pat. No. 3,781,506, the referenced United States Patent cannot make accurate temperature control, if the kind of a load being heated is changed, which means that only a predetermined load such as a cooking pan for exclusive use therefor can be used in the apparatus of the referenced United States Patent.

Accordingly, a principal object of the present invention is to provide an improved induction heating cooking apparatus.

Another object of the present invention is to provide an induction heating cooking apparatus without possibility of wasteful consumption of an electric power.

A further object of the present invention is to provide an induction heating cooking apparatus, wherein a much more consideration has been given to the safety.

Still a further object of the present invention is to provide an induction heating cooking apparatus, wherein effective heating control can be made without regard to the kinds of a load being heated.

Still another object of the present invention is to provide an induction heating cooking apparatus, wherein no overcurrent flows even in the case where a different load being heated is placed on the apparatus.

It is another object of the present invention to provide an induction heating cooking apparatus, wherein temperature control can be made with accuracy without regard to the kinds of a load being heated.

It is a further object of the present invention to provide an induction heating cooking apparatus of a multiple performance with an inexpensive cost.

These objects and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a perspective view showing an outline of one embodiment of the present invention;

DESCRIPTION OF THE PREFERRED EMBODIMENTS

Figure 2A:
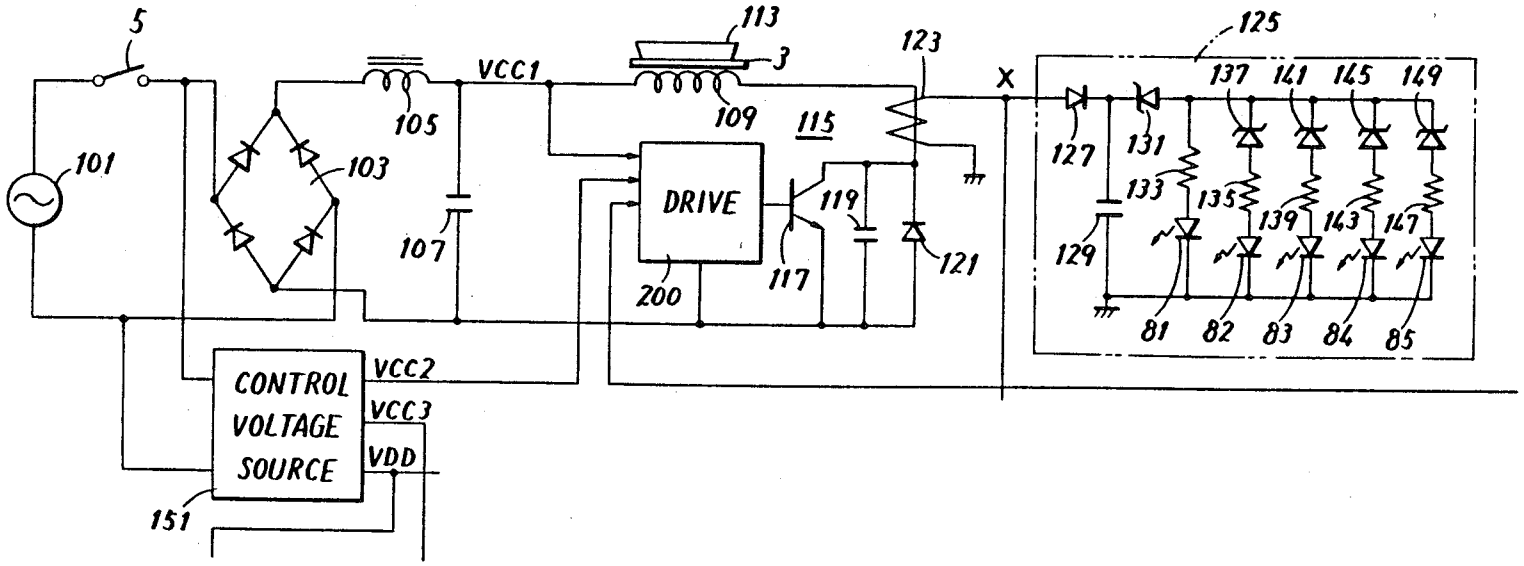
FIG. 2 is a schematic diagram of one embodiment of the present invention.

FIG. 1 is a perspective view showing one embodiment of the present invention. The induction heating cooking apparatus 1 comprises a housing or casing 2. An electrically insulating top plate 3 of such as a ceramic plate is provided on the top surface of the casing 2. Although not shown, an induction heating coil of a spiral shape is provided beneath the top plate 3. A control panel 4 is provided on the front surface of the casing 2. A power source switch 5 and a light emitting diode 51 for displaying an on state or an off state of the power supply switch are provided on the control panel 4. A selecting switch knob 6 is also provided on the control panel 4. The selecting switch knob 6 is commonly used to adjust the temperature or to adjust the output power by means of variable resistors, not shown, provided in a ganged fashion with a control knob 7. More specifically, the apparatus 1 is adapted to set the temperature of a load being heated, not shown, or to set the output power as a function of the position of the control knob 7. The settable temperature range is divided into two ranges, one being a relatively lower temperature range of 60° C. to 100° C. and the other being a relatively high temperature range of 160° C. to 200° C. Accordingly, the selecting switch knob 6 is structured to be switchable to three positions. The three positions are the first position for use in setting the temperature within a relatively low temperature range using a variable resistor, not shown, the second position for use in setting the temperature within a relatively high temperature range using a variable resistor, and a third position for use in adjusting the output power using a variable resistor. The control panel 4 is further provided with five light emitting diodes 81 to 85. These light emitting diodes 81 to 85 are aimed to display the level of the output power. More specifically, since the inventive apparatus 1 does not use a flame for the purpose of heating, it is not impossible to discern with what heating intensity a load being heating is being heated. Therefore, the light emitting diodes 81 to 85 are used to display the heating intensity by a light emitting state. A thermistor 9 is further provided beneath the top plate 3 for the purpose of detecting the temperature of a load being heated placed on the top plate 3. The control panel 4 is further provided with a switch 10, to be described subsequently in more detail. The switch 10 is aimed to forcibly render disabled a detecting circuit and so on to be described subsequently.

FIG. 2 is a schematic diagram of one embodiment of the present invention. A commercial alternating current voltage source 101 is used as a power supply of the induction heating cooking apparatus shown. The commercial alternating current voltage source 101 is connected through a power supply switch 5 to a full wave rectifying circuit 103 and is also connected to a control voltage source 151. A choke coil 105 is connected to one output terminal of the full wave rectifying circuit 103 and a capacitor 107 is connected in parallel with the rectifying circuit 103. The choke coil 105 is aimed to remove a high frequency component and the capacitor 107 is connected as a high frequency bypassing capacitor. Accordingly, the capacitor 107 is selected to be of a small capacitance value as small as 10 microfarad, so as to exhibit a sufficiently high impedance with respect to the frequency of the commercial alternating current voltage source 101, say 50 Hz or 60 Hz, and also to exhibit a low impedance with respect to a high frequency signal. Thus, a ripple source voltage VCC1 varying between 0 to 140 V is obtained from the junction between the choke coil 105 and the capacitor 107. The ripple source voltage VCC1 is applied to a driver circuit 200. The capacitor 107 is shunted by a series connection of an induction heating coil 109 and a self-excited inverter 115. As described previously, the induction heating coil 109 is wound in a spiral shape beneath the top plate 3. A pan 113 made of metal including iron as a constituent serving as a load being heated is illustratively placed on the top plate 3. The self-excited inverter 115 comprises a parallel circuit of a transistor 117, a capacitor 119 and a diode 121. A drive voltage is applied from the driver circuit 200 to the base electrode of the transistor 117. A high frequency current obtained from the inverter 115 including the transistor 117, the resonance capacitor 119 and the diode 121 is applied to the induction heating coil 109 and accordingly the induction heating coil 109 generates a high frequency alternating magnetic field. The high frequency alternating magnetic field is applied through the top plate 3 to the load 113 being heated such as a pan or tray.

Figure 3:
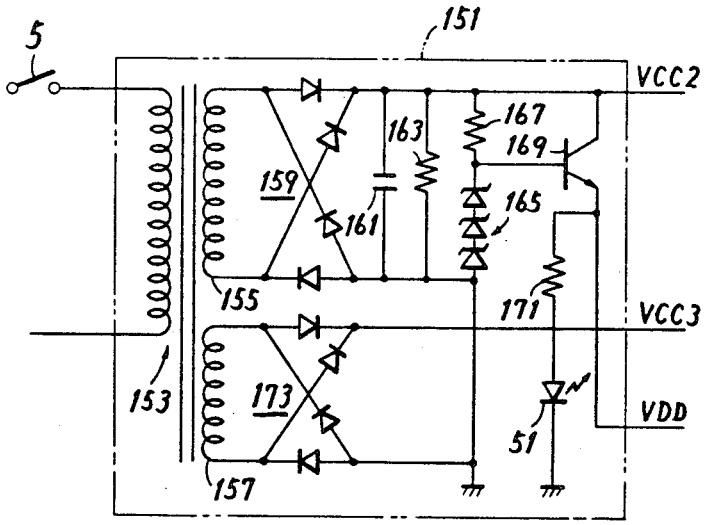
FIG. 3 is a schematic diagram showing in more detail a control voltage source circuit.

The control voltage source circuit 151 provides three kinds of voltage sources or signals. Referring to FIG. 3, the control voltage source circuit 151 will be described in detail.

The control voltage source circuit 151 comprises a step down transformer 153. A primary winding of the step down transformer 153 is supplied with a commercial alternating current voltage upon turning on of the power supply switch 5. The transformer 153 further comprises a secondary winding 155 and a third winding 157. The output of the secondary winding 155 is full rectified by a full rectifying circuit 159, whereupon the same is smoothed by a capacitor 161 and a resistor 163 to be converted to a direct current voltage. The direct current voltage is voltage divided by a resistor 167 and a constant voltage element 165 and the divided voltage is applied to the base electrode of a transistor 169. The collector electrode of the transistor 169 is connected to the output line for withdrawing the control source voltage VCC2. The emitter electrode of the transistor 169 is connected to the output line for providing the control source voltage VDD. At the same time, the emitter electrode of the transistor 169 is connected through a resistor 171 and the light emitting diode 51 to the ground. On the other hand, the output of the third winding 157 is full wave rectified by a full wave rectifying circuit 173, whereupon the same is withdrawn as a ripple signal VCC3. The control source voltage VCC2 is withdrawn as a direct current voltage of approximately 24 V and is used as a driving voltage source of a driver circuit 200 to be described subsequently. The control source voltage VDD is converted to a stable direct current voltage of approximately 13 V and is used as a driving voltage source of various circuits to be described subsequently. The ripple signal VCC3 is a ripple voltage varying between 0 to 40 V and is applied to the start circuit 300 to be described subsequently. Thus, upon turning on of the power supply switch 5, the respective control source voltages VCC2, VCC3 and VDD are obtained and at the same time the light emitting diodes 51 is driven to emit light, whereby turning on of the power supply is notified.

Returning again to FIG. 2, a current transformer 123 is coupled to a current path of the induction heating coil 109. Accordingly, a high frequency voltage of a variation corresponding to the high frequency current flowing through the induction heating coil 109 is obtained at the output point X of the current transformer 123. The voltage obtained from the output point X is applied to an output control circuit 400, an overload detecting circuit 900, a load detecting circuit 700, a non-load detecting circuit 800 and so on to be described subsequently. At the same time, the output voltage obtained from the point X is also applied to an output display circuit 125. The output display circuit 125 comprises a diode 127, which serves to rectify the output voltage obtained from the output circuit X. The rectified output thus obtained is smoothed by a capacitor 129 and is converted into a direct current. The voltage across the capacitor 129, i.e. the direct current voltage is applied through a zener diode 131 to the circuit of the respective light emitting diodes 81, 82, 83, 84, and 85. The light emitting diode 81 is connected in series with a resistor 133. The light emitting diodes 82, 83, 84 and 85 are connected in series with resistors 135, 139, 143 and 147, and zener diodes 137, 141, 145 and 149, respectively in series. Accordingly, if and when the output voltage obtained from the output point X exceeds the zener voltage of the zener diode 131, the voltage is supplied to the series circuits of these light emitting diodes 81 to 85. The zener voltages of the zener diodes 137, 141, 145 and 149 and the resistance values of the resistors 135, 139, 143 and 147 are selected such that the same may become larger in succession in the above described order. Accordingly, as the output voltage obtained from the output point X of the current transformer 123 increases, the light emitting diodes are driven to emit light in succession from the light emitting diode 81 to the light emitting diode 85, with the result that the output power is displayed. These light emitting diodes 81 to 85 are provided on the control panel 4 shown in FIG. 1, so that the current output power can be visually confirmed by the operator.

Figure 2B:
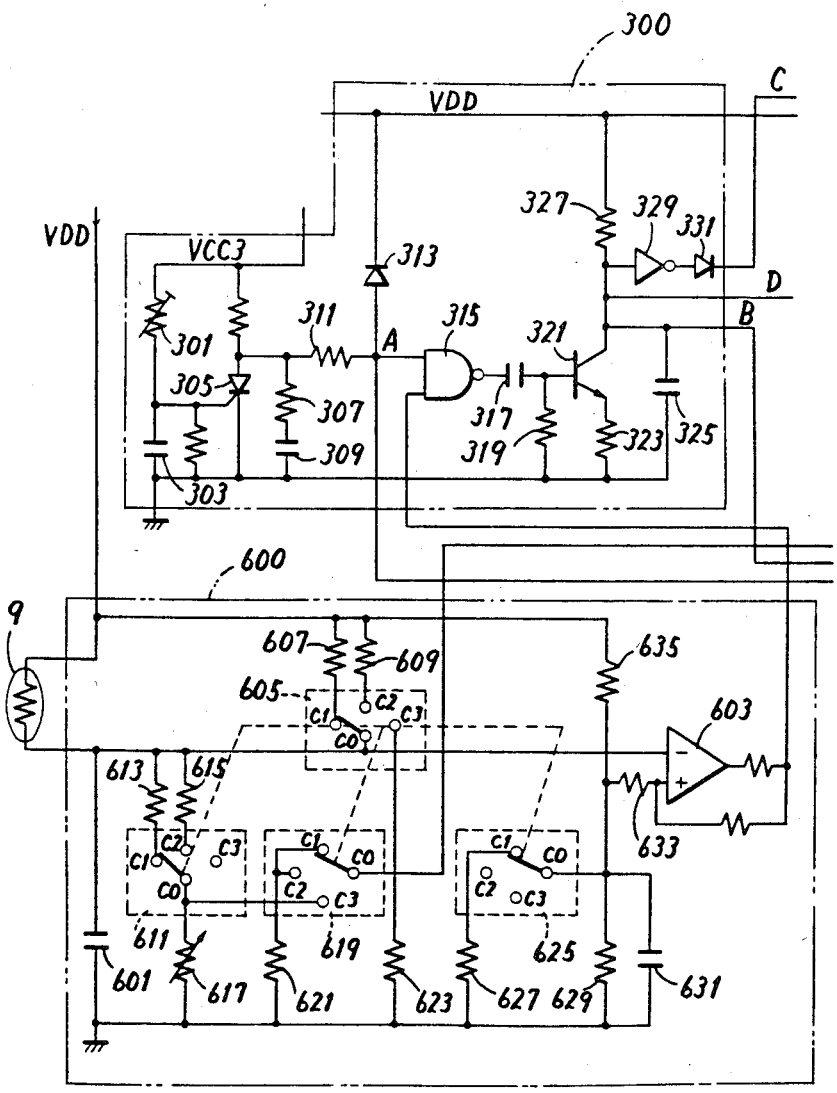

Now referring to FIG. 2B, the start circuit 300 will be described in detail. The start circuit 300 receives the source voltage VDD as the drive voltage source and also receives the ripple signal VCC3. The start circuit 300 is aimed to provide a start signal to trigger the inverter 115 at each cycle of the ripple source voltage VCC1. The ripple signal VCC3 obtained from the control voltage source 151 is applied to the series connection of the variable resistor 301 and the capacitor 303 and is also applied across the thyristor 305. The gate electrode of the thyristor 305 is connected to the junction of the series connection of the variable resistor 301 and the capacitor 303. Accordingly, the thyristor 305 is driven to be rendered conductive at each cycle of the ripple signal VCC3. More specifically, the rise of each cycle of the ripple signal VCC3 is differentiated by the variable resistor 301 and the capacitor 303 and the differentiated pulse is applied to the gate electrode of the thyristor 305. Thus, the thyristor 305 is turned on at the beginning of each cycle of the ripple source voltage VCC1 (VCC3) and is turned off when the ripple signal VCC3 becomes zero at the end of each cycle.

A series connection of a resistor 307 and a capacitor 309 is connected in parallel between the anode and the cathode of the thyristor 305. The resistor 307 and the capacitor 309 are aimed to absorb a noise component such as a rush current occurring on the occasion of turning on of the power supply switch 5. The anode of the thyristor 305 is connected through a resistor 311 to the junction A. The junction A is connected to one input of a NAND gate 315 and the signal at the junction A is applied to the circuits 700 and 800 to be described subsequently. A diode 313 is connected between the junction A and the voltage source line VDD. The diode 313 is provided to protect the input of the NAND gate 315 from exceeding the source voltage VDD. The NAND gate 315 provides the low level output, if and when the other input from the circuit 600 to be described subsequently is the high level and the voltage at the junction A, i.e. one input thereto exceeds an operating threshold voltage Vth of the circuit 315. The output of the NAND gate 315 is applied through a capacitor 317 to the base electrode of a transistor 321. The base electrode of the transistor 321 is further connected through a resistor 319 to the ground. The capacitor 317 constitutes a diffrentiation circuit and accordingly the transistor 321 is rendered conductive for a predetermined time period when the output of the NAND gate 315 rises from the low level to the high level. The emitter electrode of the transistor 321 is connected through a resistor 323 to the ground. The resistor 323 is selected to be larger than the resistor 319. A capacitor 325 for eliminating an influence of a noise is connected between the collector and emitter electrodes of the transistor 321. At the same time, the collector electrode of the transistor 321 is supplied with the source voltage VDD through the resistor 327. The output from the collector electrode of the transistor 321 is obtained, as such, as the pulse signals B and D and, after inversion through an inverter 329 and a diode 331, as the pulse signal C. Meanwhile, the diode 331 is aimed to prevent a reverse flow from the output control circuit 400 to be described subsequently. The signal C is used as a start pulse. The signals B and D are obtained as having substantially the same waveform.

Figure 2C:
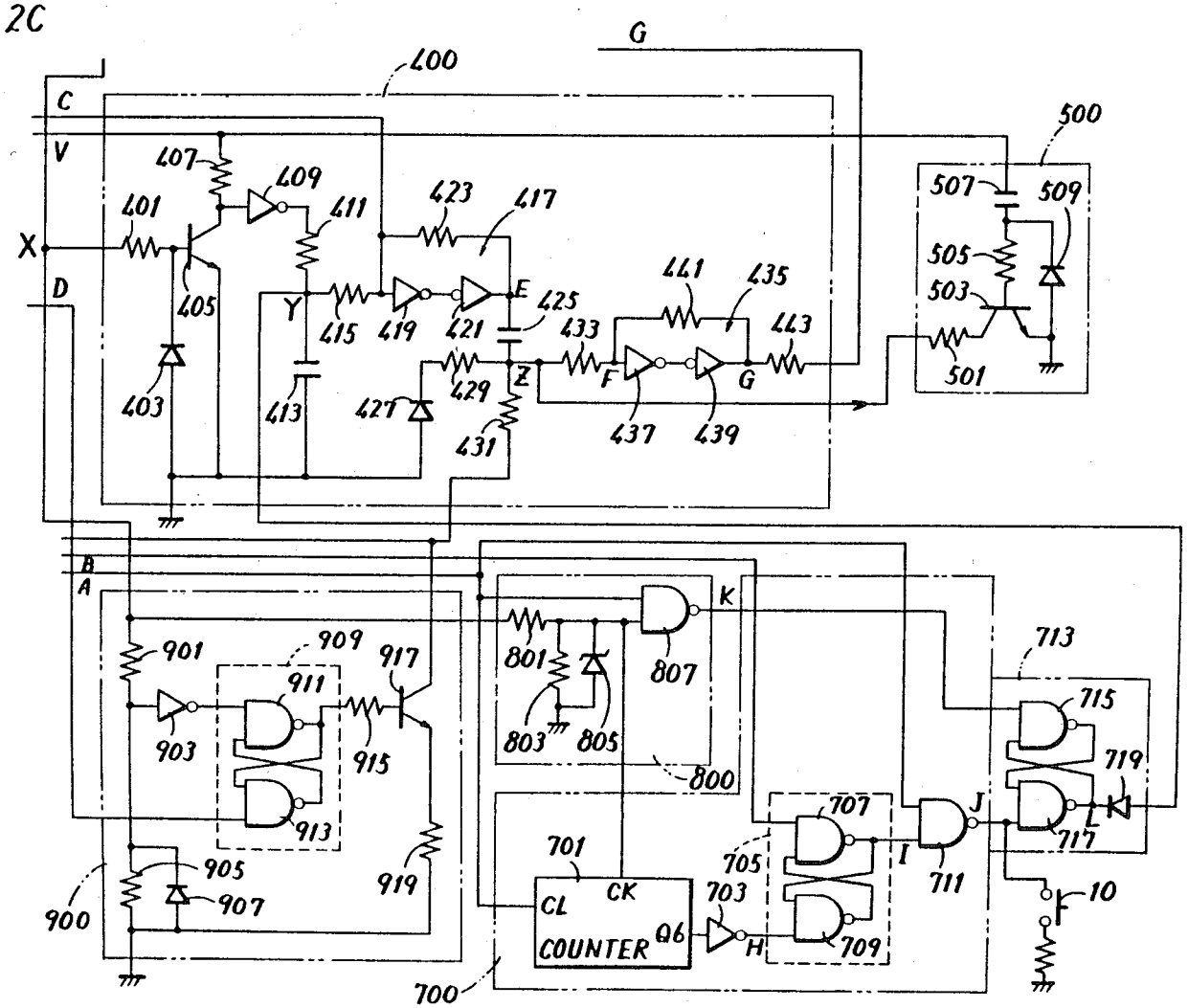

Now referring to FIG. 2C, the output control circuit 400 will be described in detail. The output control circuit 400 comprises a transistor 405, the base electrode of which is connected through a resistor 401 to the output point X of the current transformer 123 (FIG. 2A). A diode 403 is connected to the base electrode of the transistor 405. The diode 403 is provided to protect the transistor 405. More specifically, the diode 403 serves to clip the reverse voltage between the base and emitter electrodes of the transistor 409. The emitter electrode of the transistor 405 is connected to the ground and the collector electrode of the transistor 405 is connected through a resistor 407 to the source voltage VDD. The collector electrode of the transistor 405 is further connected through an inverter 409 and a resistor 411 to the junction Y. The junction Y is further connected through a capacitor 413 to the ground and through a resistor 415 to the input of an inverter 419. The inverter 419 as well as an inverter 421 at the subsequent stage constitute a Schmitt trigger circuit 417. A start pulse signal C obtained from the start circuit 300 (FIG. 2B) is applied to the input of the inverter 419. A resistor 423 is inserted between the input of the inverter 419 and the output of the inverter 421, i.e. the junction E, for the purpose of increasing the switching speed. The output point E of the inverter 421 is connected through a differentiation capacitor 425 to the junction Z. The junction Z is connected through a diode 427 and a resistor 429 to the ground and through a resistor 431 to a contact C0 of the switch 613 (FIG. 2B) included in the circuit 600 to be described subsequently. The junction Z is further connected through the resistor 431 to the collector electrode of a transistor 917 of the circuit 900 to be described subsequently. The charging time constant of the capacitor 425 is primarily determined by a resistor 615 (FIG. 2B) and a resistor 431. Accordingly, a differentiated pulse is obtained at the junction Z responsive to the rise of the output point E of the Schmitt circuit 417. The junction Z is further directly connected to the output delay circuit 500 to be described subsequently and is also connected through a resistor 433 to the input F of an inverter 437. The inverter 437 and an inverter 439 at the subsequent stage both constitute a Schmitt trigger circuit 435. A resistor 441 for increasing the switching speed is connected between the output point G and the input point F of the circuit 435. The signal obtained from the output point G of the Schmitt circuit 435 is applied through a resistor 443 to the drive circuit 200 to be described subsequently as a start signal. Thus, the output control circuit 400 provides a start signal G of the high level the time period of which has been defined responsive to the start pulse C obtained from the start circuit 300 and the start signal G is applied to the drive circuit 200. At the same time, the output control circuit 400 receives a voltage from the output point X of the current transformer 123 and provides a start signal G of the high level of a predetermined time period determined responsive thereto, whereby oscillation of the inverter 115 is continued. Accordingly, the period when the inverter 115 makes oscillation responsive to the start signal G obtained from the output control circuit 400 can be referred to as "oscillation period". On the other hand, the inverter 115 comes not to make oscillation in the vicinity of the fall trailing end of the ripple voltage source VCC1 at each cycle of the ripple voltage source VCC1, as to be described subsequently. Therefore, the period after the rest of oscillation at the end of the preceding cycle in the case where the apparatus has been performing a normal operation until the oscillation is started again responsive to the start signal G of the subsequent cycle can be referred to as "non-oscillation period". Furthermore, the state in which the start pulse C is obtained but the inverter 115 does not make oscillation can be referred to as "oscillation rest period".

Figure 4:
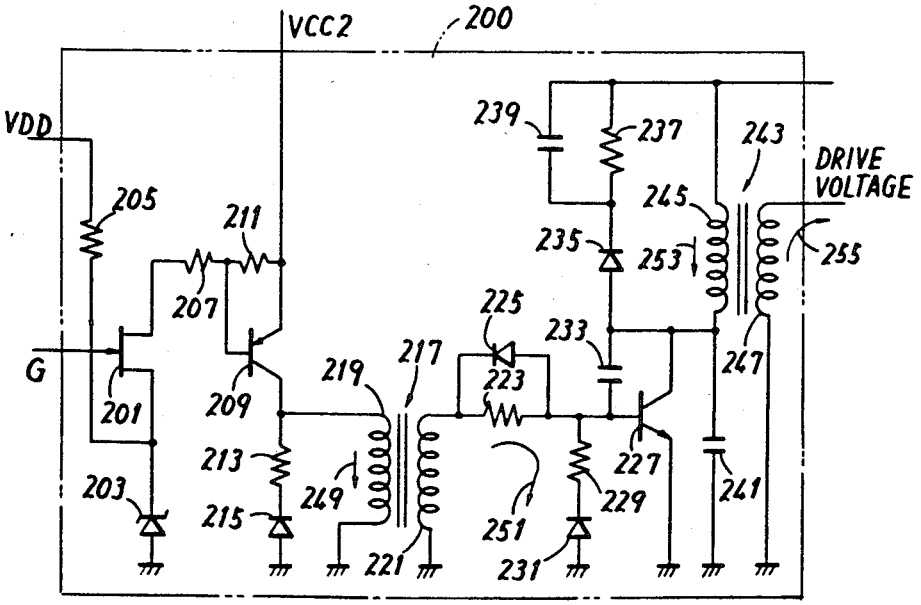
FIG. 4 is a schematic diagram showing in detail a driver circuit.

Now referring to FIG. 4, the driver circuit 200 will be described in detail. The driver circuit 200 receives the start signal G from the output control circuit 400. The signal G is applied to the gate electrode of a transistor 201. The source electrode of the transistor 201 is connected to the ground through a zener diode 203 and is also connected to receive the source voltage VDD through a resistor 205. The drain electrode of the transistor 201 is connected to the base electrode of a transistor 209 through a resistor 207. The emitter electrode of the transistor 209 is connected to receive the direct current voltage VCC2 of approximately 24 V from the control voltage source circuit 151. The resistor 211 is connected between the emitter and base electrodes of the transistor 209. The collector electrode of the transistor 209 is connected to the ground through a series connection of a resistor 213 and a diode 215. The primary winding 219 of a pulse transformer 217 is connected to the transistor 209. The secondary winding 221 is electromagnetically coupled to the primary winding, with the same polarity of the primary and secondary windings 219 and 221. The output from the secondary winding 221 is applied to the base electrode of a transistor 227 through a parallel circuit of a resistor 223 and a diode 225. The base electrode of the transistor 227 is connected to the ground through a series connection of a resistor 229 and a diode 231. The emitter electrode of the transistor 227 is connected to the ground. A capacitor 233 is connected between the collector and base electrode of the transistor 227 and a capacitor 241 is connected between the collector and emitter electrodes of the transistor 227. The collector electrode of the transistor 227 is connected to the ripple voltage source VCC1 through the primary winding 245 of a pulse transformer 243. A series connection of a diode 235 and a parallel circuit of a resistor 237 and a capacitor 239 is connected in parallel with the primary winding 245 of the pulse transformer 243. The primary winding 245 and the secondary winding 247 are electromagnetically coupled, with the same polarity of windings. The output from the secondary winding 247 is applied to the base electrode of the switching transistor 117 of the inverter 115 as a drive voltage.

Consider a case where the drive signal G being applied to the driver circuit 200 becomes the high level for a predetermined time period. At that time the transistor 201 is rendered conductive and accordingly the transistor 209 is rendered conductive during only that high level period. Accordingly, a current flows in the direction of the arrow 249 in the primary winding 219 of the pulse transformer 217 during that high level period. Accordingly, a current also flows in the direction of the arrow 251 in the secondary winding 221 during that high level period. Therefore, the transistor 225 is rendered conductive and a current flows in the primary winding 245 of the pulse transformer 243 in the direction of the arrow 253 from the ripple voltage source VCC1 during the above described high level period. Accordingly, a current of the polarity shown by the arrow 255 is induced in the secondary winding 247 coupled to the primary winding 245 during that high level period. Therefore, the transistor 117 having the base electrode connected to the secondary winding 247 is rendered conductive during that period.

When the start signal G changes from the high level to the low level, the transistor 201 is rendered non-conductive and the transistor 209 is also rendered non-conductive. Then the energy stored in the primary winding 219 of the pulse transformer 217 is discharged and accordingly a current flows in the secondary winding 221 in the direction opposite to that of the arrow 251. Therefore, the transistor 227 is reverse biased to the rendered non-conductive. Accordingly, the energy stored in the primary winding 245 of the pulse transformer 243 is discharged and the switching transistor 217 constituting the inverter 115 is reverse biased to be rendered non-conductive. Thus, the driver circuit 200 renders the switching transistor 117 conductive during the time period when the start signal G is the high level and renders the switching transistor 117 non-conductive during the time period when the start signal G is the low level.

Now returning again to FIG. 2, the output delay circuit 500 will be described. The output delay circuit 500 is provided to ensure detection of the load state and the load kind on the occasion of turning on of the power supply. The operation of the circuit 500 will be described subsequently in more detail. The output delay circuit 500 comprises a transistor 503. The collector electrode of the transistor 503 is connected to the junction Z included in the previously described output control circuit 400 through a resistor 501. The emitter electrode of the transistor 503 is connected to the ground. The base electrode of the transistor 503 is connected through a capacitor 507 and a resistor 505 for differentiation to the voltage source line VDD of the control voltage source circuit 151. A diode 509 is connected between the junction of the capacitor 507 and the resistor 505 and the emitter electrode of the transistor 503. The diode 509 is connected to discharge the electric charge in the capacitor 507. In the output delay circuit 500, the transistor 503 is rendered conductive on the occasion of turning on of the power supply, with the result that the resistor 501 is connected to the junction Z in parallel.

Now referring to FIG. 2B, the temperature output adjusting circuit 600 will be described in detail. The temperature output adjusting circuit 600 performs two functions. More specifically, one is to set the temperature of the load being heated with the output power being set to a predetermined value, thereby to perform a controllable temperature adjusting function. The other is to perform an output adjusting function for arbitrarily setting the output power within a predetermined range. In the embodiment shown, the temperature adjustment has been divided into two temperature ranges, i.e. a relatively low temperature range of 60° C. to 100° C., and a relatively high temperature range of 160° C. to 200° C. However, such setting of the temperature variable range may be only one or alternatively three or more. Such temperature adjusting function would be suited for such materials being cooked for which a cooking temperature should be more strictly determined. The output adjusting function can arbitrarily set and control the output power being consumed by the induction heating coil 109 within the range of 500 W to 1350 W. By thus adjusting the output power, the energy supply amount to the load being heated is adjusted. Such output adjusting function is suited for a case where at the beginning the strong heating is applied and midway of a series of cooking steps the weak heating is applied thereafter. Meanwhile, such temperature adjustment or output adjustment is visually indicated by the output display circuit 125. More specifically, in the case where the temperature adjusting function is to be operated, all or a portion of the light emitting diodes 81 to 85 (FIGS. 1 and 2A are driven to emit light until a predetermined set temperature is reached. Upon reaching the set temperature, the high frequency current being applied to the induction heating coil 109 is stopped, whereby light emission of these light emitting diodes 81 to 85 is stopped. As a result, the operator can learn whether the load being heated has reached the temperature originally set. In the case where the output adjusting function is to be operated, all or a portion of the light emitting diodes 81 to 85 are energized to emit light depending on the output power being set. As a result, the operator can confirm whether the output power being set by himself is the intended one.

As described previously with reference to FIG. 1, the thermistor 9 is disposed around the center beneath the top plate 3 of the cooking apparatus 1 for the purpose of detecting the temperature. One end of the thermistor 9 is connected to the source voltage VDD of the control voltage source circuit 151. The thermistor 9 may be a negative characteristic thermistor, for example. One end of the negative characteristic thermistor 9 is further connected to the plus input of a differential amplifier 603 through resistors 633 and 635. The other end of the negative characteristic thermistor 9 is connected to one input of the differential amplifier 603. The temperature output adjusting circuit 600 comprises four switches 605, 611, 619 and 625. These four switches 605, 611, 619 and 625 are switched in a ganged fashion depending on the turning on of the selecting switch knob 6 (FIG. 1). Each of these switches 605, 611, 619 and 625 comprises one contact C0 and three contacts C1, C2 and C3. The contacts C1 and C2 are used for temperature adjustment so that the previously described temperature ranges may correspond thereto. The contact C3 is used for output adjustment. The switches 605 and 611 are used for temperature adjustment and the switch 619 is used for selection between the temperature adjustment and the output adjustment. The switch 625 is used for setting the reference level.

The contacts C1 and C3 of the switch 605 are connected through resistors 607 and 609, respectively, to the voltage source VDD. The contact C3 of the switch 605 is connected through a resistor 623 to the ground. The contact C0 of the switch 605 is connected to the other end of the negative characteristic thermistor 9. The contacts C1 and C2 of the switch 611 are connected through resistors 613 and 615, respectively, to the other end of the negative characteristic thermistor 9, i.e. the one input of the differential amplifier 603. The contact C0 of the switch 611 is maintained open and the contact C0 of the switch 611 is connected through a variable resistor 617 to the ground. The contacts C1 and C2 of the switch 619 are connected commonly through a resistor 621 to the ground. The contact C3 of the switch 619 is connected to the contact C0 of the switch 611, i.e. one end of the variable resistor 617. The contact C0 of the switch 619 is connected through a resistor included in the previously described output control circuit 400 to the junction Z. The contact C1 of the switch 625 is connected through a resistor 627 to the ground and the other contacts C2 and C3 of the switch 625 are maintained open. The contact C0 of the switch 625 is connected through a parallel circuit of resistors 629 and 631 to the ground and also through a resistor 633 to the plus input of the differential amplifier 603 and further through a resistor 635 to one end of the negative characteristic thermistor 9. Accordingly, the plus input of the differential amplifier 603 receives, as a reference voltage, a voltage obtained by dividing the direct current voltage VDD by means of the resistors 635 and 629. The differential amplifier 603 provides the high level output if and when the reference voltage being applied to the plus input is larger than the voltage being applied to the minus input and provides the low level output in the reversed situation. The output of the differential amplifier 603 is applied to the other input of the NAND gate 315 included in the start circuit 300, as described previously. A capacitor 601 is connected between the other end of the negative characteristic thermistor 9 and the ground.

The variable resistor 617 can be controlled by the knob 7 (FIG. 1) so that the resistance value thereof may be arbitrarily adjusted. The variable resistor 617 is used both for temperature adjustment and output adjustment. More specifically, in the case where the selecting switch knob 6 is turned to the uppermost or the middle in FIG. 1, the contacts C0 of the respective switches are connected to the contacts C1 or C2. In the case where the knob 6 is turned to the uppermost, the contacts C1 and C0 are connected and accordingly the temperature can be arbitrarily adjusted within the relatively low temperature range of 60° C. to 100° C. by means of the variable resistor 617. In the case where the knob 6 is turned to the middle, the contacts C2 and C0 are connected. Accordingly, in such a case the temperature can be arbitrarily set within the relatively high temperature range of 160° C. to 200° C. by means of the variable resistor 617. When the knob 6 is turned to the lowermost, the contacts C3 and C0 are connected and accordingly the output power can be set to a desired level within the range of 500 W to 1350 W by means of the variable resistor 617.

Now consider a case where the knob 6 is turned to the uppermost. In such a case, the contacts C1 and C0 are connected in the respective switches 605, 611, 619 and 625. Accordingly, in such a state, the resistor 629 is shunted by the resistor 627 by the switch 625. Therefore, in such a case, the reference potential being applied to the plus input of the differential amplifier 603 is lower than that in other cases. On the other hand, the potential being applied to the minus input of the differential amplifier 603 is determined by the resistors 605 and 613 and the thermistor 9 and the variable resistor 617. Since the temperature of the load being heated increases, the resistance value of the thermistor 9 decreases. Then, the potential being applied to the minus input of the differential amplifier 603 gradually increases and ultimately the output of the differential amplifier 603 turns to the low level. Since the low level output of the differential amplifier 603 is applied to the other input of the NAND gate 315, thereafter no signal is obtained from the gate 315, with the result that thereafter no start pulse C is obtained from the circuit 300. Accordingly, it would be appreciated that, by connecting the contacts C1 and C0 of the respective switches, a desired temperature can be set or controlled within the relatively low temperature range of 60° C. to 100° C. by means of the variable resistor 617.

Now consider a case where the knob 6 is turned to the middle. In such a case, the contacts C2 and C0 of the switches 605, 611, 619 and 625 are connected. Accordingly, the reference voltage being applied to the plus input of the differential amplifier 603 is determined by the resistor 629 and becomes larger than that of the previously described case. Thus, the voltage being applied to the minus input of the differential amplifier 603 is determined by the resistors 609, 615 and the variable resistor 617 and the negative characteristic thermistor 9. Accordingly, as the temperature increases, the resistance value of the negative characteristic thermistor 9 decreases, and in the same manner as described previously, the voltage being applied to the minus input of the differential amplifier 603 gradually increases and eventually the output of the amplifier 603 turns to the low level. Thus, with the contacts C2 and C0 connected, the temperature can be arbitrarily set within the relatively high temperature range of 160° C. to 200° C. by means of the variable resistor 617.

Meanwhile, the operation in the case where the knob 6 is turned to the lowermost, i.e. the contacts C3 and C0 of the respective switches are connected, will be described subsequently in more detail.

It is necessary that the switch 605 is structured as a non-shorting type switch. More specifically, the switch 605 need be structured such that in turning from the contact C1 to the contact C2 or in reversely turning the moving contact must be turned from the contact C1 or C2 through a state of not contacting any of the contacts C1 and C2, i.e. through an opened state, to the contact C2 or C1. Considering a case where the contact C0 is contacted simultaneously to both of the contacts C1 and C2, it follows that both of the two resistors 607 and 609 are simultaneously connected in parallel with the negative characteristic thermistor 9. Accordingly, the voltage being applied to the minus input of the differential amplifier 603 instantaneously increases, with the result that the voltage exceeds the difference voltage being applied to the plus input of the differential amplifier 603. Then, the output of the amplifier 603 turns to the low level, whereupon the heating operation is stopped. Since the heating operation is brought to a stop in spite of the fact that the load being heated has not reached a set temperature, such stop of the heating operation is not desired and must be avoided. For the purpose of avoiding such situation, a non-shorting type switch is used as the switch 605.

Now the switch 619 must be implemented as a shorting type switch. More specifically, the switch 619 need be structured such that in turning from the contact C1, C2 or C3 to the other contact the contact C0 need be necessarily contacted to any contact. For example, in turning from the contact C2 to the contact C3, assuming a situation of the contact C0 not contacting any contact, the resistance value between the contact C0 and the ground becomes infinite. Accordingly, the charging time constant of the capacitor 425 of the output control circuit 400 becomes extremely large. Therefore, the time period of the start signal G from the circuit 400 also becomes extremely large, with the result that the conduction period of the switching transistor 117 of the inverter 115 becomes extremely long. Therefore, the current flowing through the transistor 117 becomes larger than the rated value for the transistor 117, with the result that there is a fear of damage of the transistor 117.

Now the load detecting circuit 700 constituting one feature of the present invention will be described in detail. The load detecting circuit 700 is aimed to detect that a load being heated is placed on the top plate 3 (FIG. 1). The load detecting circuit 700 comprises a counter 701. The counter 701 receives at the clock input CK a high frequency voltage from the output of the current transformer 123 after voltage division by means of resistors 801 and 803 included in the non-load detecting circuit 800. The counter 701 also receives, as a clear input CL, the signal A from the start circuit 300. The counter 701 has ten output terminals, so that the high level output signal is obtained from the output terminals corresponding to the count value obtained by counting the clock pulse being applied to the clock input CK. In the embodiment shown the signal obtained from the sixth output terminal Q6 is used among the ten output terminals of the counter 701. Accordingly, the counter 701 provides the high level signal from the output terminal Q6, when six clock signals (the voltage signals obtained from the output point X) are counted. The count value being obtained from the output of the counter 701, i.e. the value "6" in the embodiment shown, is used as a reference for determining the presence of a load being heated. More specifically, in the embodiment shown, if and when six or more pulses are applied to the counter 701 due to an attenuating oscillation detected by the current transformer 123 during the oscillation rest period of the inverter 115, it is determined that the situation is a no load state, wheres if five or fewer pulses are applied, the situation is determined as a load state. Accordingly, the count value such as "6" of the counter 701 may be suitably selected to the optimum numerical value depending on the attenuating oscillation characteristic of the inverter 115, the kind, the magnitude and so on of the load being heated and so on. The output Q6 from the counter 701 is applied to the reset input of a flip-flop 705 as the signal H, after inversion by an inverter 703. The flip-flop 705 comprises two cascade connected NAND gates 707 and 709. The set input of the flip-flop 705 is supplied with the signal B obtained from the start circuit 300 (FIG. 2B). The non-inverted output I of the flip-flop 705, i.e. the output of the NAND gate 707 is applied to one input of the NAND gate 711. The other input of the NAND gate 711 is connected to receive the signal A from the start circuit 300. Accordingly, the NAND gate 711 is responsive to the states of the signals A and I to provide the output signal J. The output J of the NAND gate 711 is applied to the reset input of the flip-flop 713. The flip-flop 713 comprises two cascade connected NAND gates 715 and 717. The set input of the flip-flop 713 is connected to receive a signal K obtained from the non-load detecting circuit 800 to be described subsequently. The inverted output L of the flip-flop 713, i.e the output of the NAND gate 717, is applied to the junction Y of the output control circuit 400 through the diode 719. Meanwhile, the diode 719 is aimed to prevent a reverse current flow.

The reset input of the flip-flop 713, i.e. one input of the NAND gate 717 is connected to one end of the operation switch 10 (FIG. 1). The other end of the operation switch 10 is connected to the ground through a resistor. Accordingly, upon turning on of the operation switch 10, the flip-flop 713 is forcibly reset. The operation switch 10 is utilized in the case where it is desired to heat a load which is usually detected as too small. More specifically, the embodiment shown is structured such that when such a small load is placed on the top plate 3 the heating operation is stopped so that such a small load may not be undesirably heated; however, only if and when it is desired that such a small load is heated, the operation switch 10 is turned on for that purpose.

Now the non-load detecting circuit 800 will be described in detail. The circuit 800 comprises a NAND gate 807. One input of the NAND gate 807 is connected to the junction A of the start circuit 300. The other input of the NAND gate 807 is connected to receive a voltage signal from the output point X of the current transformer 123 through a resistor 801, after voltage division by resistors 801 and 803. The resistor 803 is shunted by a zener diode 805, so that the zener diode 805 protects the input of the NAND gate 807 from exceeding the zener voltage. The NAND gate 807 is responsive to the input signal A and the input signal X to provide the output K. The output from the NAND gate 807 is applied as a signal K to the set input of the previously described flip-flop 713. The non-load detecting circuit 800 is aimed to detect that the load being heated placed on the top plate 3 is removed. Accordingly, if and when the load being heated placed on the top plate 3 is removed, the output K from the NAND gate 807 is turned to the low level.

Now a description will be made of an overload detecting circuit 900 which is another aspect of the present invention. The overload detecting circuit 900 is aimed to prevent damage of electronic components caused by an over input due to a difference in the material of a load being heated or caused by an accidental rush current. The circuit 900 comprises a flip-flop 909. The flip-flop 909 comprises cascade connected NAND gates 911 and 913. The set input of the flip-flop 909, i.e. one input of the NAND gate 911 is connected to receive the output of an inverter 903. The input of the inverter 903 is connected to the junction of resistors 901 and 905. The other end of the resistor 901 is connected to the output point X of the current transformer 123 (FIG. 2A). Accordingly, the inverter 903 is supplied with a voltage signal obtained from the output voltage X after voltage division by the resistors 901 and 905. The other input of the flip-flop 900, i.e. one input of the NAND gate 913, is connected to receive a signal D from the start circuit 300 (FIG. 2B). The resistor 905 is shunted by a half-wave rectifying diode 907. The non-reversed output of the flip-flop 909, i.e. the output of the NAND gate 911, is connected through a resistor 915 to the base electrode of the transistor 917. The collector electrode of the transistor 917 is connected to one end of the resistor 431 included in the output control circuit 400. The emitter electrode of the transistor 917 is connected through a resistor 919 to the ground. The overload detecting circuit 900 detects the above described over input or accidental rush current, thereby to decrease a high frequency current flowing through the induction heating coil 109, whereby electronic components such as the transistor 117 are protected. Upon detection of such over input or over rush current, the transistor 917 is rendered conductive. Accordingly, at that time the resistor 919 is substantially shunted by the previously described resistor 621. Therefore, the charging time constant of the capacitor 425 included in the output control circuit 400 becomes small and thus the time period of the start signal G becomes short. As the time period of the start signal G becomes short, the oscillation frequency of the inverter 115 is increased and the output is decreased.

Now that the structural features were described in the foregoing, the operation of the induction heating cooking apparatus of the embodiment shown will be described in the following with reference to various waveforms shown in FIGS. 5 to 9.

I. Normal Heating Operation

Figure 5:
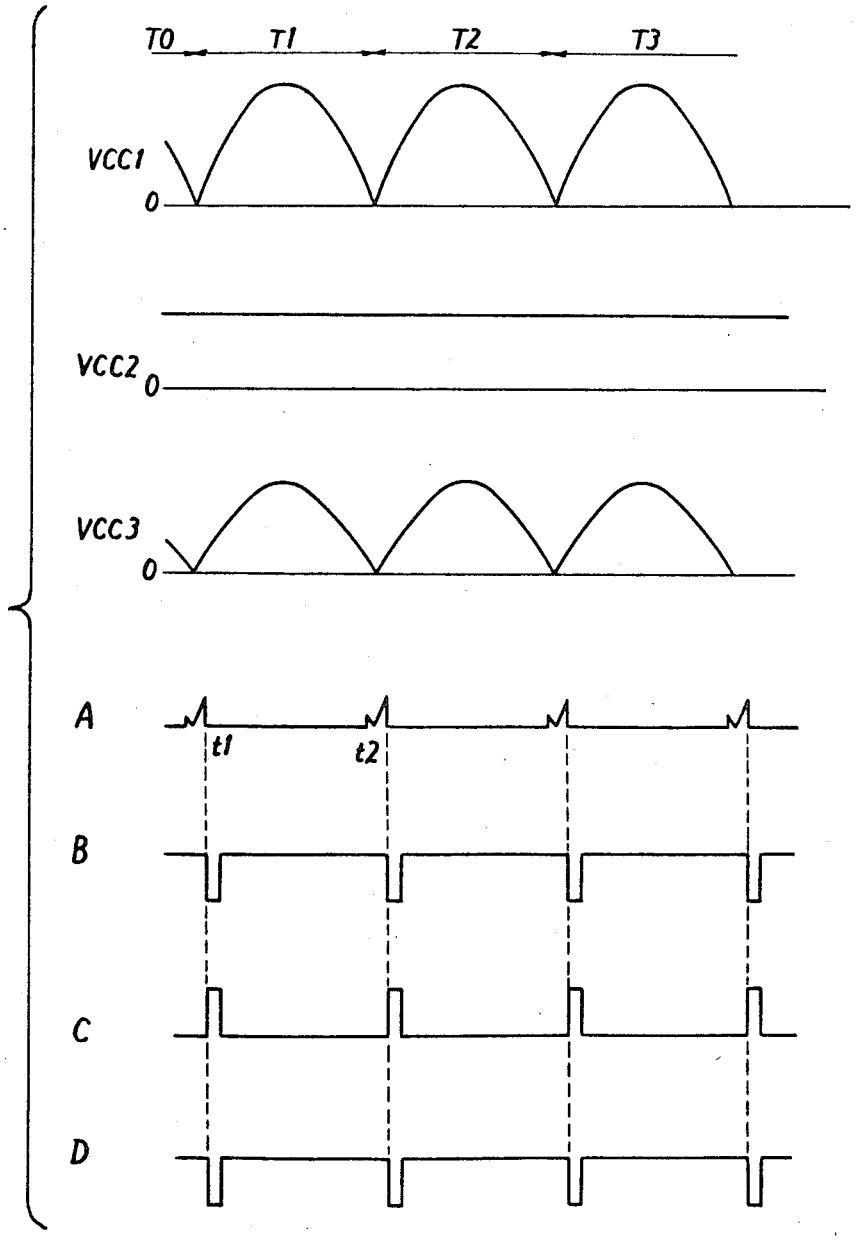
FIG. 5 is a graph showing waveforms for explaining the operation of the start circuit.

The normal heating operation may be defined as an operation in the case where a proper load being heated is placed on the top plate 3. Let it be assumed that the selecting switch knob 6 has been turned to the uppermost position. More specifically, consider a case where the respective switches 605, 611, 619 and 625 of the temperature output adjusting circuit 600 have been turned such that the contacts C1 and C0 are connected. In such a situation, as described previously, a desired heating temperature can be set to any temperature within the relatively low temperature range of 60° C. to 100° C. by adjusting the resistance value of the variable resistor 617 by means of the knob 7. Let it be assumed that in such a situation the power supply switch 5 is turned on at the timing T0 shown in FIG. 5. Then, the ripple source voltage VCC1 is obtained as a ripple voltage changing between 0 and 140 V, as shown in FIG. 5. At the same time, a ripple signal VCC3 having the amplitude of approximately 40 V is obtained from the control voltage source circuit 151. The ripple signal VCC3 is applied to the start circuit 300. In the start circuit 300 the thyristor 305 is turned on after the lapse of a predetermined time period t1 from 0 V during the time period T1 rising from 0 V of the ripple signal VCC3. Meanwhile, the time period t1 is determined by the charging time constant of the variable resistor 301 and the capacitor 303 and, in the case of a given example, the time period t1 is selected to be approximately 1 milisecond. Conduction of the thyristor 305 continues until the timing t2 when the ripple signal VCC3 approaches again 0 V after the lapse of the above described time period t1. More specifically, as the ripple signal VCC3 approaches 0 V, the current of the thrysistor 305 decreases to be smaller than the holding current, so that the same is turned off at the timing t2. Thus, the thyristor 305 repeats the turn on and turn off operation in accordance with the period of the ripple signal VCC3. When the thyristor 305 thus repeats the turn on and turn off operation, a voltage signal A shown as "A" in FIG. 5 appears at the junction A. Meanwhile, the period of the ripple signal VCC3 is a half of the period of the commercial alternating current voltage source 101 and is 10 miliseconds, (in the case of the commercial power supply of 50 Hz).

When the thyristor 305 is rendered conductive, the junction A, i.e. one input of the NAND gate 315 turns from the high level to the low level. On the othe hand, a load being heated 113 placed on the top plate 3 is still a normal temperature and accordingly the output of the operational amplifier 603 remains the high level. Accordingly, the other input of the NAND gate 315 is the high level. Therefore, the output of the NAND gate 315 turns from the low level to the high level. Then a differentiated pulse is obtained from the capacitor 317. Accordingly, the transistor 321 is placed in a conduction state for a predetermined time period determined by the time constant of the capacitor 317 and the resistor. Therefore, the collector electrode of the transistor 321 becomes the low level for that time period. Therefore, the signals B and D of the circuit 300 exhibit waveforms as shown as "B" and "D" in FIG. 5. On the other hand, the signal B at the collector electrode of the transistor 321 is reversed by the inverter 329 to be the start pulse C. The start pulse C thus assumes the high level during the conduction period of the transistor 321, as shown as "C" in FIG. 5. The start pulse C is applied to the output control circuit 400.

The start pulse C from the start circuit 300 is applied to the input of the inverter 419 constituting the Schmitt circuit 417 of the output control circuit 400. Accordingly, the output of the inverter 419 becomes the low level during that time period and the output E of the inverter 421 becomes the high level during the time period.

Since the waveforms of these signals E to G are of a high frequency signal of 20 to 40 kHz, the time base thereof is extremely small as compared with the waveforms shown in FIG. 5. Therefore, the waveforms of such signals are shown separately in FIG. 6.

Figure 6:
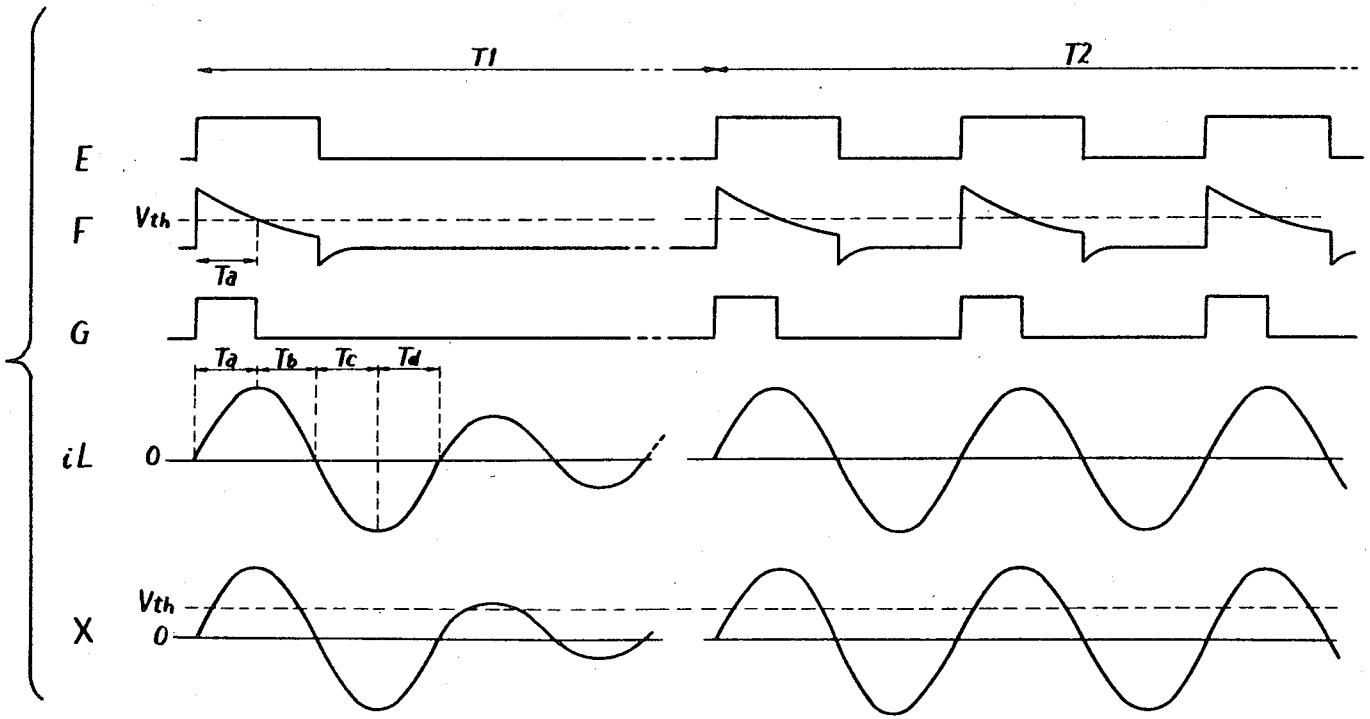
FIG. 6 is a graph showing waveforms for explaining the operation of the output control circuit and the inverter.

Now referring to FIG. 6, the signal E becomes the high level only during the conduction time period of the transistor 321, as shown as "E" in FIG. 6. Accordingly, the junction Z and thus the junction F is supplied with a differentiated pulse obtained by the capacitor 425 and the resistor connected thereto. More specifically, at the junction F, a pulse is obtained as shown as "F" in FIG. 6, which rises simultaneously with the rise of the signal E and gradually falls with the charging time constant determined by the capacitor 425 and the resistor connected thereto. If and when the signal F does not reach a threshold value voltage Vth of the inverter 437 constituting the Schmitt circuit 435, the output of the inverter 437 becomes the high level and the output G of the inverter 439 becomes the low level. The signal G is shown as G in FIG. 6. The output of the inverter 439 is applied as a start signal G to the driver circuit.

When the start signal G of the high level is thus applied, a drive voltage is obtained from the secondary winding 247 (FIG. 4) of the pulse transformer 243 of the driver circuit 200 for that period for forward biasing the switching transistor 117. Accordingly, during the time period of the drive voltage, the transistor 114 is rendered conductive. Therefore, a load current iL starts flowing as shown in FIG. 6 in the induction heating coil 109 from the ripple voltage source VCC1. The load current iL is detected by the current transformer 123 and accordingly a voltage signal as shown as "X" in FIG. 6 is obtained at the output point X of the current transformer. When the voltage signal X increases to a predetermined value, the transistor 405 receiving the voltage signal X is rendered conductive. When the transistor 405 is rendered conductive, the input of the inverter 409 becomes the low level and accordingly the output thereof, i.e. the voltage at the junction Y becomes the high level. Therefore, the output E of the inverter 421 constituting the Schmitt circuit 417 becomes the high level. Since the Schmitt circuit 417 and the capacitor 413 constitute a delay circuit, the output of the inverter 421 is obtained with a slight time delay with respect to the input of the inverter 419. The significance of such delay circuit will be described subsequently. When the output of the inverter 421 becomes the high level, the output of the inverter 439 constituting the Schmitt circuit 435 also becomes the high level. On the other hand, the capacitor 425 is gradually charged with the time constant determined by the capacitor 425 and the resultant resistance. Upon completion of the charging of the capacitor 425, the voltage at the junction Z decreases. If and when the voltage at the junction Z and thus the voltage at the junction F becomes lower than the threshold value of the inverter 437, the output of the inverter 437 becomes the high level and accordingly the output of the inverter 439, i.e. the start signal G becomes the low level. When the start signal G turns to the low level, the switching transistor 117 is rendered non-conductive. Referring to FIG. 6, the time period when the transistor 117 is rendered conductive is shown as Ta.

When the transistor 117 is rendered non-conductive, the energy stored in the induction heating coil 107 during the previous period Ta is discharged during the subsequent period Tb. The discharging energy from the induction heating coil 109 is charged in the resonance capacitor 119. Upon completion of the charging in the capacitor 119, the electric charge in the capacitor 119 is discharged through the path of the capacitor 119-the coil 109-the capacitor 107-the capacitor 119 during the subsequent period Tc. Accordingly, during that period Tc, the energy is stored in the induction heating coil 109. Then during the following period Td the energy stored in the induction heating coil 109 is discharged through the path of the coil 109-the capacitor 107-the diode 121-the coil 109. Thus, one cycle of oscillation of the inverter 115 due to the start pulse C and thus the start signal G is completed.

When the load current iL again rises in the positive going direction from zero, the voltage at the output point X of the current transformer 123 renders the transistor 405 conductive. As a result, the output of the inverter 409 turns to the high level.

On the other hand, let it be assumed that the output L of the NAND gate 717 constituting the flip-flop 713 is the low level. Then the junction Y has been held in the low level. Therefore, even if the output of the inverter 409 has become the high level as described above, the input of the inverter 419 remains the low level. Accordingly, the start signal G from the circuit 400 is not obtained thereafter and the transistor 117 is maintained in a non-conductive state. Therefore, after the period Td in FIG. 6, an attenuating or damped, oscillation occurs due to the induction heating coil 109 and the capacitor 119. Such change is shown as the period T1 in FIGS. 6 and 7.

Such attenuating oscillation rapidly attenuates, if and when a proper load has been placed on the top plate 3. Such change is shown in the period T1 in FIGS. 6 and 7. The above described attenuating oscillation is detected by the current transformer 123 and the output signal X is voltage divided by the resistsors 801 and 803 of the non-load detecting circuit 800 and the voltage divided output is applied to the NAND gate 807. At the same time, the voltage signal X, as voltage divided, is applied to the counter 701 as the clock input CK. The counter 701 counts only the pulses exceeding the threshold voltage Vth among the applied clock signals. In the case where a proper load has been placed on the top plate 3, the count value in the counter 701 does not reach the value "6" by such attenuating oscillation. More specifically, if and when a proper load has been placed, only about two pulses, at the most, can be counted by the counter 701 out of the pulses of such attenuating oscillation. Accordingly, the output Q6 of the counter 701 remains the low level and the output H of the inverter 703 remains the high level. Meanwhile, since one input of the NAND gate constituting the flip-flop 705 has been supplied with the signal B as described previously at the beginning of the period T1, the output of the NAND gate 707, i.e. the non-inverted output of the flip-flop 705 remains the high level.

When the ripple signal VCC3 again rises thereafter, at the beginning of the subsequent period T2 the start pulse C is obtained from the start circuit 300. The start pulse C is applied from the output control circuit 400 to the driver circuit 200 as the start signal G. The transistor 117 is rendered conductive responsive to the start signal G, whereby the inverter 115 starts oscillation. On the other hand, as the start pulse C is generated, the output J of the NAND gate 711 turns to the low level. The signal J is applied to the input of the NAND gate 717 constituting the flip-flop 713. Accordingly, the flip-flop 713 is reversed of the state and the output L thereof turns to the high level as shown as "L" in FIG. 7. Accordingly, one cycle oscillation is completed responsive to the above described start pulse C and, when the load current iL rises again from zero in the subsequent period, the transistor 405 is rendered conductive and the output of the inverter 409, i.e. the junction Y is brought to the high level. Therefore, the output of the Schmitt circuit 417 turns to the high level and the output of the Schmitt circuit 435, i.e. the start signal G turns again to the high level. The start signal G is applied to the driver circuit 200 and accordingly the switching transistor 117 is again rendered conductive, so that the load current iL again starts flowing. Since the output L of the NAND gate 717 is the high level in such a situation, the input of the inverter 419 is the high level and the voltage signal from the output X of the current transformer 123 is as such applied to the Schmitt circuit 417. Thus, the inverter 115 continues self-excited oscillation. The oscillation stops, when the ripple source voltage VCC1 decreases to become lower than a predetermined value determined by the amplification factor of the transistor 117 and the amplification factor of the driver circuit 200 and the transistor 117 is rendered conductive at the time t2. Such change is shown in the periods T2 and T3 in FIGS. 6 and 7. Thus, in the embodiment shown, the inverter 115 repeats such oscillation at each half cycle of the low frequency alternating current voltage source 101 depending on the ripple voltage source VCC1, i.e at each cycle of the ripple voltage source VCC1. Due to such high frequency oscillation of 20 to 40 kHz repeated at each cycle, a high frequency alternating magnetic field is generated by the induction heating coil 109. Accordingly, a proper load placed on the top plate 3 is induction heated.

As described in the foregoing, when the load 113 being heated placed on the top plate 3 starts being heated, the temperature of the load is detected by the thermistor 9. If and when the load reaches the temperature set by the variable resistor 617, as described previously, the output of the differential amplifier 603 turns from the high level to the low level. Accordingly, one input of the NAND gate 315 of the start circuit 300 turns to the low level and accordingly the signal from the NAND gate 315 remains the low level. Therefore, the transistor 321 is not rendered conductive and the start pulse C is not generated. Therefore, the inverter 115 stops oscillation, whereby the heating operation is stopped. Thereafter the temperature of the load being heated decreases and the resistance value of the thermistor 9 increases, whereby the output of the differential amplifier 603 turns again to the high level and the start pulse C is again generated from the start circuit 300. Thus, the temperature of the load being heated is maintained to that set by the knob 7 and thus by the variable resistor 617.

Now the purpose of providing the delay circuit in the output control circuit 400 will be described. The delay circuit comprises the capacitor 413 and the inverters 419 and 421. The delay circuit is aimed to delay the output E of the inverter 421 with respect to the input of the inverter 419 with a slight delay time, say 2 microseconds.

Figure 8:
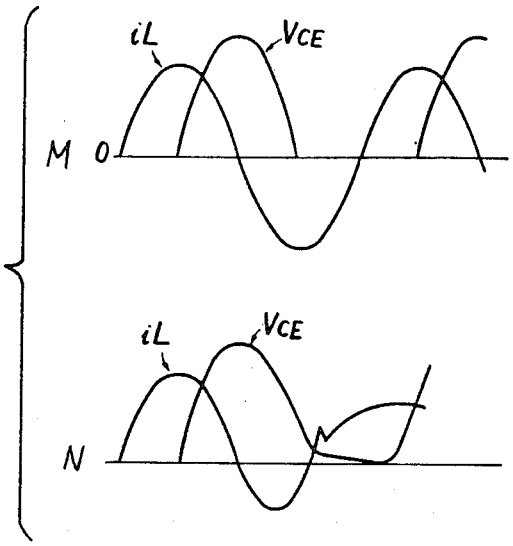
FIG. 8 is a graph showing waveforms for explaining the operation of the delay circuit included in the output control circuit.

Usually, in controlling the output power by controlling the frequency, when the resonance frequency of the inverter is set to the lower frequency side, i.e. the output "strong", then the resistance component $R(=2\pi f0L+(1/2\pi f0C)$, where f0 is the oscillation frequency) in the circuit becomes larger when the frequency is changed to the higher frequency side, i.e. the output is changed to "weak", with the result that the charging capacitance of the resonance capacitor 119 becomes apparently small and the same is quickly discharged. In such a case, the transistor 117 is brought to the conductive stage before the collector-emitter voltage $VC_{CE}$ of the transistor 117 decreases to 0 V, which causes heat in the transistor 117 and thus to cause the thermal damage. This will be described in more detail with reference to FIG. 8. Referring to FIG. 8, "M" shows an operation state in the case of the lower frequency region, i.e. the output "strong" when the resonance frequency of the inverter 115 has been set to the lower frequency side. Conversely, "N" in FIG. 8 shows an operation state in the case of the high frequency region, i.e. the output "weak" when the resonance frequency is set to the lower frequency side. As shown as "M" in FIG. 8, in the case where the resonance frequency is set to the lower frequency side so that the operation is made in the lower frequency side, the load current iL and the collector-emitter voltage $V_{CE}$ of the switching transistor 117 are in a normal relation. However, in the case of "N" shown in FIG. 8, the transistor is again rendered conductive, before the collector-emitter voltage $V_{CE}$ of the switching transistor 117 decreases to 0 V. For the purpose of preventing the same, therefore, the delay circuit is implemented by the capacitor 113 and the inverters 419 and 421. After the collector-emitter voltage $V_{CE}$ of the transistor 400 fully becomes 0, the transistor 117 is rendered conductive.

Now the output adjusting operation will be described. For the purpose of output adjustment, the knob 6, (FIG. 1) is turned to the lowermost position, so that the contact C3 and C0 of the respective switches included in the circuit 600 may be connected. Then the resistance value of the variable resistor 617 is adjusted by means of the knob 7 (FIG. 1). As a result, the composite resistance in cooperation with the capacitor 425 included in the output control circuit 400 is changed and accordingly the time constant of the capacitor 425 and the resultant resistance is changed. This means that it is possible to change the time period Ta after the rise of the input signal F of the inverter 437 until the fall thereof to the operation threshold voltage Vth of the inverter 437. Accordingly, it is possible to change the time period of the start signal G and thus to change the conduction period of the switching transistor 117. Thus by changing the conduction period of the switching transistor 117, the amount of the electromagnetic energy stored in the induction heating coil 109 is changed. More specifically, as the time period Ta is shortened and the time period of the start signal G is decreased, the electromagnetic energy supplied to the induction heating coil 109 decreases, with the result, that the output of the inverter 115 and thus the output of the coil 109 is decreased. At that time the oscillation frequency of the inverter 115 becomes the higher. Conversely, when the time period Ta is set to be longer, the output of the inverter 115 and thus the output of the coil 109 is increased. At that time the oscillation frequency becomes lower.

Meanwhile, the level of the output power thus adjusted is visually indicated by the output display circuit 125. More specifically, as the output gradually increases, the voltage signal at the output point X of the current transformer 123 increases in proportion thereto. The voltage signal X is rectified by the diode 127 and is smoothed by the capacitor 129, whereupon the same is applied to the zener diode 131. When the direct current voltage becomes lower than the zener voltage of the zener diode 131, the zener diode is rendered conductive and the light-emitting diode 81 is driven to emit light. As the output further increases, the light-emitting diodes 82, 83, 84 and 85 are in succession driven to emit light and with the maximum output state all of the emitting diodes 81 to 85 are driven to emit light.

When the respective switches of the temperature output adjusting circit 600 have been turned for output adjustment such that the contacts C3 and C0 are connected, one input of the differential amplifier 603 is connected to the ground through the switch 605 and the resistor 623. Therefore, the output of the differential amplifier 603 becomes normally the high level and in such a situation it is considered that the temperature of the load being heated is unlimitedly increases. However, when the load heated in such a situation and the resistance value of the thermistor 9 decreases, the voltage at the contact C0 of the switch 605 increases. Accordingly, when the said voltage increases to exceed the reference voltage being applied to the plus input of the differential amplifier 603, the output of the amplifier 603 turns to the low level. Therefore, generation of the start pulse C from the start circuit 300 is stopped thereafter, whereby the load being heated is prevented from being heated unlimitedly. By selecting properly the resistance value of the resistor 623, it is possible to suitably set the upper limit temperature, whereby the same serves as a safety apparatus.

II. In Case of Overload

In general, the material and the size of a load being heated such as a cooking pan, tray or the like for use in the induction heating cooking apparatus are restricted to a proper one. However, in actual use it could happen that an improper load (a cooking pan) is placed on the top plate 3 of a cooking apparatus. For example, in heating a load comprising 18-8 stainless (comprising 18% chrome and 8% nickel) indicated as SuS304, for example, an overcurrent flows in the induction heating coil 109 due to a small resistance value thereof. If such overcurrent flows, there is a problem that a circuit breaker to the commercial power supply is interrupted undesirably or circuit components, particularly the transistor 117, of the apparatus are damaged. Therefore, in the embodiment shown, means is provided for detecting generation of an overcurrent or generation of any other accidental rush current in the case where an improper load is placed, thereby to suppress such overcurrent.

A voltage signal corresponding to the load current iL flowing in the induction heating coil 109 is obtained by means of the current transformer 123. The voltage signal is divided by means of the resistors 901 and 905 and is applied to the inverter 903. Normally, it has been adapted such that the input voltage of the inverter 903 does not exceed the operation threshold voltage. If and when an overcurrent exceeding the normal value flows through the coil 109, then the input voltage of the inverter 903 becomes accordingly high to exceed the threshold value voltage of the inverter 903. Then the output of the inverter 903 becomes the low level and the output of the NAND gate 911 constituting the flip-flop 909 turns to the high level. More specifically, if and when an improper load of a small resistance value is placed on the top plate 3 and the heating operation is performed, then the non-inverted output of the flip-flop 909 turns to the high level. The transistor 917 is responsive to the output of the flip-flop 909 to be rendered conductive. Due to conduction of the transistor 917, the resistor 919 comes to be connected in series with the resistor 431 of the output control circuit 400. Accordingly, the resultant resistance determining the charging time constant in cooperation with the capacitor 425 decreases. Therefore, the charging time constant determined by the resultant resistance and the capacitor 425 decreases. Accordingly, the voltage at the junction F turns more quickly to be lower than the operational threshold value of the inverter 437, so that the time period of the period of the output signal G of the inverter 439 is shortened. Accordingly, the time period of the drive voltage obtained from the driver circuit 200 determined dependent on the time period of the start signal G, i.e. the conduction time period Ta of the switching transistor 117 is also shortened. The fact that the conduction period of the switching transistor 117 is shortened means that, as described previously, the output power is decreased.

Figure 9:
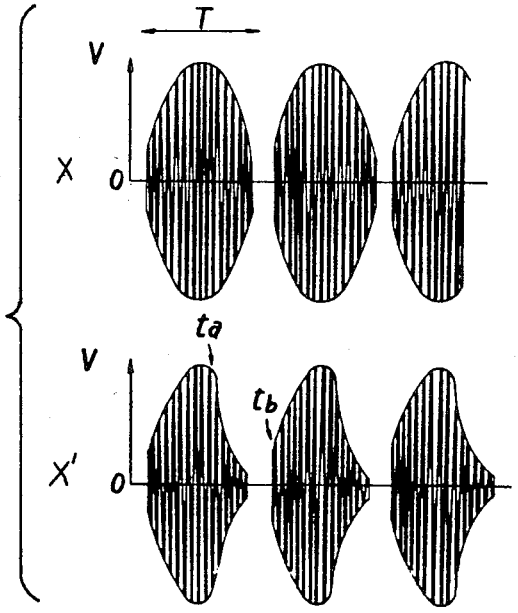
FIG. 9 is a graph showing waveforms for explaining the operation for preventing an overcurrent in the case where a special load is placed on the apparatus.

FIG. 9 shows the waveform of the output voltage X of the current transformer 123. In the case where a proper load being heated is placed on the top plate 3, a predetermined intermittent oscillation is repeated as shown as "X" in FIG. 9. However, in the case where an improper load being heated is placed on the top plate, the overload detecting circuit 917 becomes operable. Accordingly, as shown as "X'" in FIG. 9, the oscillation frequency becomes higher responsive to conduction of the transistor 917 and the output power becomes small. Thus, an overcurrent is prevented from flowing into the induction heating coil 109. Accordingly, various circuit components of the apparatus are effectively protected. In particular, since the output voltage X (X') of the current transformer 123 and the collector-emitter voltage $V_{CE}$ of the switching transistor 117 are in a proportional relation, the transistor 117 is protected with certainty.

The signal D from the collector electrode of the transistor 321 of the start circuit 300 is applied to the NAND gate 913 constituting the flip-flop 909. Accordingly, the flip-flop 909 is reset at each cycle of the ripple voltage source VCC1, i.e. at the beginning at each half cycle of the low frequency alternating current voltage source 101 (at the timing tb in FIG. 9). Therefore, the transistor 917 is brought to a non-conduction state at each resetting of the flip-flop 909. Accordingly, the inverter 115 performs a normal oscillating operation thereafter; however, if the improper load being heated is left as placed, then the transistor 917 of the overload detecting circuit 900 is again rendered conductive and, as in the above described case, the output power is automatically decreased. In the case where the load placed on the top plate 3 is replaced by a proper load, thereafter the circuit 900 does not operate and a normal heating operation is continued as a matter of course.

III. In Case Where Non-load State Is Established During Heating Operation

With a conventional induction heating cooking apparatus, if and when a proper load is placed on the top plate 3 and, while a normal heating operation has been performed, the load 113 is removed from the top plate 3, then the oscillation of the inverter 115 is continued. Accordingly, with a conventional apparatus, it follows that after removal of the load an electric power is wastefully consumed. Therefore, in the embodiment shown, the oscillation of the inverter 115 is automatically stopped when the load is removed midway of the heating operation, whereby undesired consumption of the electric power is prevented.

Figure 7:
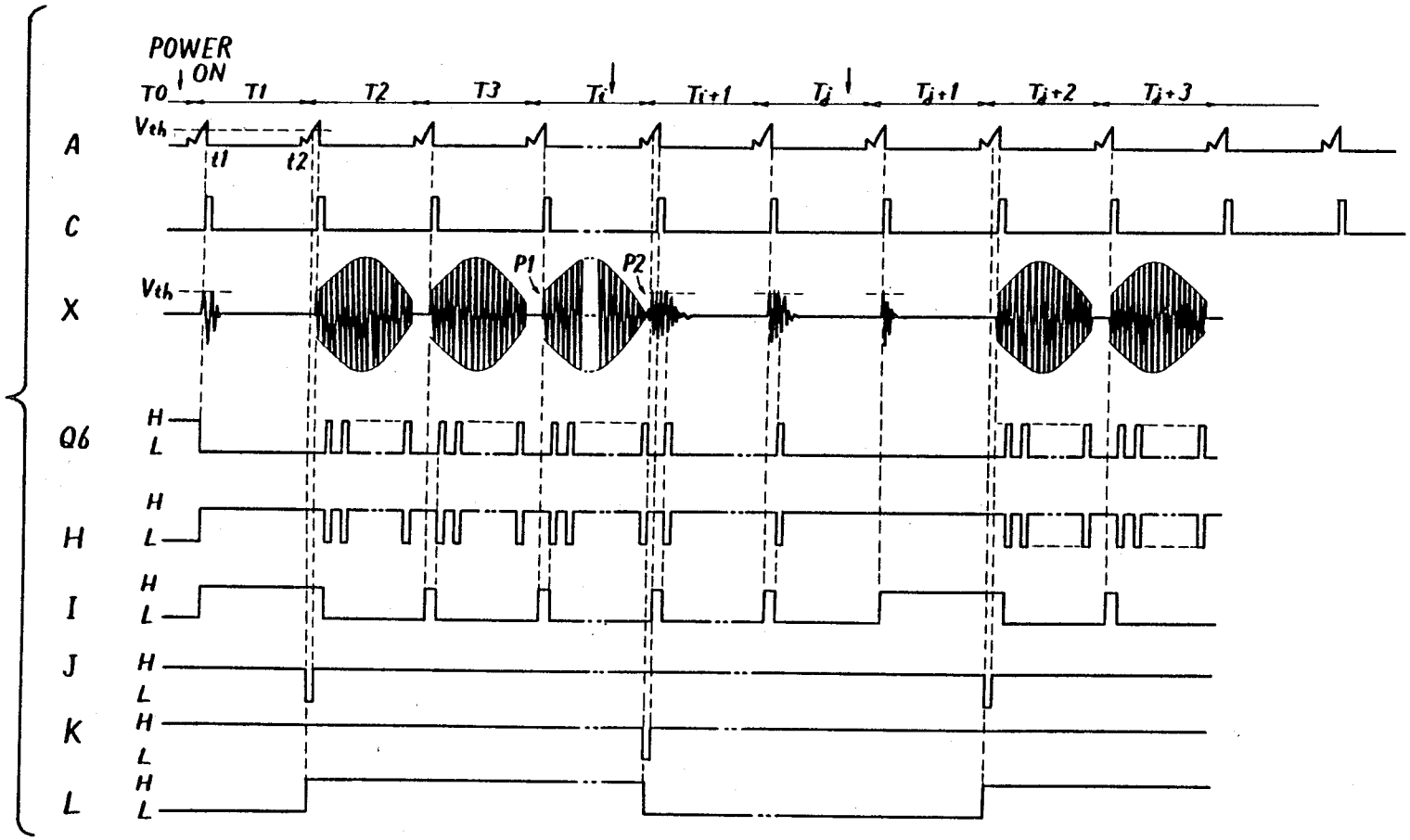
FIG. 7 is a graph showing waveforms for explaining a series of operations of the above described embodiment.

Referring to FIG. 7, now consider a case where the load is removed from the top plate 3 during a given period Ti of the ripple voltage source VCC1. When the load is removed from the top plate, an attenuating oscillation due to resonance of the induction heating coil 109 and the resonance capacitor 119 lasts longer, so that the inverter 115 still continues oscillation as shown as P2 in FIG. 7 even in the vicinity of 0 V of the ripple voltage source VCC1. Meanwhile, in the case where a proper load has been placed on the top plate 3, as shown as P1 in FIG. 7, the oscillation of the inverter 115 is stopped in the vicinity of 0 V of the fall of the ripple voltage source VCC1. The embodiment shown has been adapted such that the difference between P1 and P2 is detected by the non-load detecting circuit 800. Now referring to FIGS. 6 and 7, the operation of the non-load detecting circuit 800 will be described.

If and when the load is removed from the top plate 3 in the period Ti, then the inverter 115 has been continuing the oscillation even at the end of that period. Therefore, in the period Ti+1 following the above described period Ti, the output K of the NAND gate 807 included in the non-load detecting circuit 800 becomes the low level. More specifically, when the signal A from the start circuit 300 exceeds the operation threshold voltage Vth of the NAND gate 807, upon application of the voltage signal of the oscillation the output K of the NAND gate 807 becomes the low level. When the output K of the NAND gate 807 becomes the low level, the flip-flop 713 is reversed of the state, whereby the output L of the NAND gate 717 turns to the low level. The low level signal L is applied to the junction Y of the output control circuit 400, whereby the input of the inverter 419 is held in the low level. Accordingly, even if the voltage signal from the output point X of the current transformer 123 is applied to the transistor 405 through the resistor 401, the start signal G is not obtained from the inverter 439. Accordingly, it follows that during the period Ti+1 only the attenuating oscillation caused by the first start pulse C occurs. The above described attenuating oscillation is relatively large because of absence of a load being heated on the top plate 3, so that the operation threshold voltage of the counter 701 is exceeded thereby. In addition, because of absence of a load being heated, such attenuating oscillation continues for a relatively long period. Therefore, the counter 701 counts more than 6 voltage signals obtained from the output point X. Therefore, the output Q6 of the counter 701 becomes the high level. The output Q6 from the counter 701 is inverted by the inverter 703 to become the low level. If and when the output signal H of the inverter 703 becomes the low level as shown as "H" in FIG. 7, the output I of the NAND gate constituting the flip-flop 705 turns to the high level only during the period when the counter counts "6", as shown as "I" in FIG. 7. On the other hand, the signal A is applied from the start circuit 300 to the input of the NAND gate 711. Accordingly, the output J of the NAND gate 711 remains the high level, as shown as "J" in FIG. 7. Therefore, the state of the flip-flop 713 remains unchanged and the signal L from the NAND gate 717 remains the low level. Accordingly, the junction Y of the output control circuit 400 remains held in the low level and the start signal G is not obtained. Accordingly, after the counter 701 counts "6", the inverter 115 does not make oscillation. Thus in the case where the load being heated is thus removed from the top plate 3, the oscillation of the inverter 115 is automatically stopped. Therefore, an electric power is prevented from being wastefully consumed.

Now consider a case where after the load being heated is removed from the top plate and the oscillation is stopped, a load 13 is again placed on the top plate. In the case where a proper load is again placed on the top plate in the period Tj shown in FIG. 7, only an attenuating oscillation due to the start pulse C is caused by the inverter 115 in the following period Tj+1. However, since a proper load is placed on the top plate, the attenating oscillation becomes smaller as compared with that in the preceding period Tj. Therefore, the count value in the counter 701 does not exceed "6". Accordingly, the output Q6 in the counter 701 does not become the high level and the output I of the NAND gate 707 constituting the flip-flop 705 turns to the high level responsive to the signal B from the start circuit 300, whereupon the state is maintained. At the beginning of the following period Tj+2 the signal A is obtained from the start circuit 300. Then the output J of the NAND gate 711 turns to the low level. Then the output L of the NAND gate 717 constituting the flip-flop 713 turns to the high level. The fact that the output L turns to the high level means that a normal start signal G is obtained from the inverter 439 responsive to the signal applied to the transistor 405 of the output control circuit 400. In the case where a proper load is thus placed again on the top plate 3, the inverter 115 automatically starts oscillation whereby an heating operation is restarted.

In the case where the inverter 115 has been making oscillation and the load being placed on the top plate 3 is a small load such as a knife, fork or the like which is smaller than a proper one, then an oscillating operation must be stopped so that such load may not be undesirably heated. According to the embodiment shown, the load detecting circuit 700 detects that the load placed on the top plate 3 is an improper small load. More specifically, when a small load is placed on the top plate 3, the situation is similar to a non-load state described previously. More specifically, with a small load placed, a residual attenuating oscillation during a period corresponding to the non-oscillation period of the intermittent oscillation is relatively long and large, as in the case of the previously described non-load case. Then the same is detected by the counter 701. More specifically, the pulses exceeding a predetermined value due to an attenuating oscillation in a small load state are counted by the counter 701 and the output Q6 turns to the high level. Then, as described previously, the output signal L of the NAND gate 717 constituting the flip-flop 713 turns to the low level and the start signal G from the output control circuit 400 is not obtained thereafter. Accordingly, even if a small load is placed on the top plate during the heating operation, such is not undesirably heated and accordingly any risk of getting burnt through inadvertence is eliminated.

Now the operation of the output delay circuit 500 constituting a further aspect of the embodiment will be described. Upon turning on of the power supply switch 5, the output of the NAND gate 717 of the flip-flop 713 is not determined as to whether the same is the high level or the low level. In the case where the signal L is the high level, the junction Y of the output control circuit 400 is not held in the low level and, if the load placed on the top plate is a proper one, the inverter 115 makes a normal oscillating operation. On the other hand, in the case where no load being heated is placed on the top plate even after the power supply is turned on or, even if a load has been placed, the same is an improperly small load, then as described previously, the signal L tunrns to the low level and the oscillation of the inverter 115 is stopped. Conversely, in the case where the output L of the NAND gate 717 is the low level, if a proper load has been placed on the top plate, as in the case after the period Tj shown in FIG. 7 the inverter 115 thereafter starts a proper oscillating operation.

Meanwhile, the embodiment shown has been adapted such that for the purpose of adjusting the output power the oscillation frequency of the inverter 115 may be controlled. Accordingly, in the embodiment shown, in the case where the knob 7 is operated to set the output power to the "strong" position, it was confirmed that even when a small load smaller than a proper load is placed on the top plate a phenomenon could occur that the oscillation is stopped during the non-oscillation period. Such a state is similar to a case where a proper load is placed on the top plate 3 and accordingly in such a state the oscillation of the inverter 115 is not stopped. Therefore, such a small load as a knife, fork or the like placed on the top plate 3 through inadvertence is undesirably heated. In order to avoid such situation, the embodiment shown is provided with the output delay circuit 500. More specifically, in the embodiment shown, the resonance frequency of the inverter 115 has been set to the oscillation frequency in the case where the output power is set to the "strong" position. Accordingly, the electrostatic capacitance due to the induction heating coil 109 and the load being placed on the top plate 3 and the resistance component of the resonance capacitor 119 become minimal when the output power is set to the "strong" position while the same become the maximum when the output power is set to the "weak" position. In other words, in the embodiment shown, the load is large when the output power is set to the "strong" position and conversely the load becomes lightest when the output power is set to the "weak" position. As the load becomes light, the attenuating oscillation of the inverter 115 due to the start pulse C is relatively large and continues for a longer period, as in the non-load case. By detecting such attenuating oscillation by the non-load detecting circuit 800, such a small load as described above can be prevented from being undesirably heated.

Upon turning on of the power supply switch 5, the capacitor 507 is charged with the time constant determined by the capacitor 507, the resistor 505 and the base-emitter resistance of the transistor 503. Accordingly, at the beginning upon turning on of the power supply, the voltage higher than a predetermined value is applied between the base and emitter electrodes of the transistor 503. Therefore, for a predetermined time period, say approximately one second, at the beginning upon turning on of the power supply, the transistor 503 is placed in a conductive state. When the transistor 503 is rendered conductive, the resistor 501 is connected in parallel to the junction Z. Accordingly, the resultant resistance in cooperation with the capacitor 425 becomes small and the time period of the start signal G from the inverter 439 also becomes small. Accordingly, the time period of the drive voltage obtained from the driver circuit 200 also becomes small and the conduction time period of the switching transistor 117 also becomes short. Therefore, the oscillation frequency of the inverter 115 becomes higher and the output power becomes the "weak" state. As described previously, in the case of the output power being the "weak" state, even if a small load is placed on the top plate 3, the oscillation continues even at the trailing end of the period. Accordingly, at the leading edge of the period Ti+1 following the above described period Ti, the output K of the NAND gate 807 included in the non-load detecting circuit 800 becomes the low level. Accordingly the output L of the flip-flop 13 becomes the low level. Therefore, the junction Y is held in the low level and the start signal G is not obtained from the circuit 400 and the oscillating operation of the inverter 115 is assuredly stopped.

Meanwhile, the above described embodiment was structured such that the inverter 115 makes an intermittent oscillation. However, by properly selecting the amplification factor of the transistor 117 and the capacitance of the resonance capacitor 119 and so on, the inverter 115 can be structured to make continuous oscillation. Furthermore, by utilizing a silicon controlled rectifier in place of the switching transistor 117, the inverter can be structured to make continuous oscillation.

Even in the above described embodiments detection of the attenuating oscillation can be employed. More specifically, on the occasion of turning on of the power supply, the inverter 117 is in advance disabled, by causing the output L of the flip-flop 713 shown in FIG. 2C to the low level, for example. Then the drive voltage is applied to the base electrode of the transistor, the gate electrode of the silicon controlled rectifier and the like responsive to the start pulse C. As a result, as shown by the period T1 in FIG. 6, the inverter 115 makes an attenuating oscillation. By detecting the attenuating oscillation with the counter 701, detection can be made whether a load has been placed on the top plate 3. Even if a load has been placed on the top plate 3, if such is a small load, the same can be detected, as in the case of the previously described embodiment. Accordingly, the present invention can be equally applicable not only to the case where the inverter 115 is of intermittent oscillation but also to the case where the inverter 115 is of continuous oscillation.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An induction heating cooking apparatus comprising: low frequency voltage source power supply means for supplying a low frequency ripple voltage for electric power, intermittent high frequency oscillating circuit means being supplied with said electric power causing intermittent high frequency oscillation at predetermined intervals, said high frequency oscillation being caused during an oscillation period and being stopped during a non-oscillation period, induction heating coil means for receiving a high frequency current from said intermittent high frequency oscillating means for generating a high frequency alternating magnetic field for induction heating a load by said alternating magnetic field, oscillation detecting means for detecting the output of said intermittent high frequency oscillating means during a period corresponding to said non-oscillation period, oscillation stopping means responsive to said oscillation detected output from said oscillation detecting means for stopping said high frequency oscillation by said intermittent high frequency oscillating means, start signal generating means for generating a start signal in the vicinity of the leading edge of said low frequency ripple voltage, said intermittent high frequency oscillating means comprising self-excited oscillating circuit means responsive to said start signal from said start signal generating means for starting oscillation for maintaining said oscillation responsive to the oscillation output and for stopping said oscillation in the vicinity of the trailing end of said low frequency ripple voltage, a heat sensitive element provided in the vicinity of said load for sensing the temperature of said load, and temperature control means responsive to the output of said heat sensitive element for stopping the oscillation of said self-excited oscillation circuit means.

2. An induction heating cooking apparatus in accordance with claim 1, wherein said heat sensitive element comprises a heat sensitive resistor element, and said temperature control means comprises second resistor means connected in series with said heat sensitive resistor element, reference potential source means, potential comparing means for comparing the potential at the junction of the series connection of said heat sensitive resistor element and said second resistor means and the potential of said reference potential source means for providing an output when the potential of said junction of said series connection exceeds said potential of said reference potential source means, and temperature dependent oscillation stopping means responsive to the output of said potential comparing means for stopping the oscillation of said self-excited oscillation circuit means.

3. An induction heating cooking apparatus in accordance with claim 2, wherein said second resistor means comprises variable resistor means, whereby said temperature dependent oscillation stopping means is adapted such that the oscillation stopping temperature may be arbitrarily set by means of said variable resistor means.

4. An induction heating cooking apparatus in accordance with claim 3, wherein said second resistor means comprises a plurality of resistor elements having different resistance values, and which further comprises temperature range selecting switch means being inserted between said plurality of resistor elements and said variable resistor means for selectively connecting said variable resistor means in series with any of said plurality of resistor elements for selecting a variable temperature range.

5. An induction heating cooking apparatus in accordance with claim 4, wherein said temperature range selecting switch means comprises a plurality of first contact connected to said plurality of resistor element at one end of each thereof, a second contact connected to one end of said variable resistor means, and a switching contact for selectively connecting said second contact to any of said first contacts, and said temperature range selecting switch is structured as or non-shorting type switch for switching said switching contact from any of said plurality of first contacts to the other after said second contact is once opened.

6. An induction heating cooking apparatus in accordance with claim 1, which further comprises temperature control means responsive to the output of said heat sensitive element for stopping the oscillation of said self-excited oscillation circuit means, said temperature control means including second resistor means connected in series with said heat sensitive device, reference potential source means, potential comparing means for comparing the potential at the junction of the series connection of said heat sensitive device and said second resistor means for providing an output when the potential at said junction of said series connection exceeds the potential of said reference potential source means, and temperature dependent oscillation stopping means responsive to the output of said potential comparing means for stopping the oscillation of said self-excited oscillation circuit means, and which further comprises variable resistor means, and variable resistor selecting switch means for selectively and switchably rendering said variable resistor means associated with any of said time constant circuit means and said second resistor means, whereby said variable resistor means is adapted to be used both for said temperature control and for said output adjustment.

7. An induction heating cooking apparatus in accordance with claim 6, wherein said variable resistor selecting switch means comprises a first contact being connected to said time constant circuit means, a second contact connected to said second resistor means, and a third contact connected to one end of said variable resistor means and selectively switchable to said first contact or said second contact, said variable resistor selecting switch means being structured as a short circuiting type switch wherein said third contact is switched from one of said first and second contacts to the other of said first and second contacts after said third contact is once connected to both of said first and second contacts.

8. An induction heating cooking apparatus in accordance with claim 7, wherein said second resistor means comprises a plurality of resistor elements having different resistance values provided in parallel, and which further comprises resistor element selecting switch means for selectively connecting said variable resistor means to any of said plurality of resistor elements in series when said variable resistor means is connected to said second resistor means by means of said variable resistor selecting switch means.

9. An induction heating cooking apparatus in accordance with claim 8, wherein said variable resistor selecting switch means and said resistor element selecting switch means are structured to be switchable in a ganged fashion, and which further comprises a second resistor element, said second resistor element being connected to said second resistor means by means of said resistor element selecting switch means when said variable resistor means is connected to said time constant circuit means by means of said variable resistor selecting switch means, whereby temperature control is made by said second resistor means including said heat sensitive device and said second resistor element when said variable resistor selecting switch means is switched to said time constant circuit means.

10. An induction heating cooking apparatus in accordance with any one of the preceding claims 2 to 9, wherein said temperature dependent oscillation stopping means is responsive to the output of said potential comparing means to nullify said start signal from said start signal generating means.

11. An induction heating cooking apparatus, comprising:

means for supplying ripple electric power by rectifying commercial AC electric power, means for generating a start signal at each cycle of said ripple electric power, a self-excited oscillation type inverter responsive to said start signal from said start signal generating means for starting said high frequency oscillation and for maintaining said high frequency oscillation responsive to the output therefrom, induction heating coil means for receiving the high frequency current from said self-excited oscillation type inverter for generating a high frequency alternating magnetic field for induction heating a load, heat sensing means disposed in the vicinity of said load for sensing its temperature, temperature control means responsive to the output of said heat sensing means for stopping the oscillation of said self-excited oscillation type inverter, and output control means for controlling the high frequency current from said self-excited oscillation type inverter.

12. An induction heating cooking apparatus in accordance with claim 11, which further comprises current path means for supplying said high frequency current to said induction heating coil means, and voltage signal withdrawing means provided operatively coupled to said current path means of said induction heating coil means for withdrawing a voltage signal associated with said high frequency current, said self-excited oscillation type inverter being responsive to said voltage signal from said voltage signal withdrawing means for being driven to maintain said high frequency oscillation.

13. An induction heating cooking apparatus in accordance with claim 12, wherein said self-excited oscillation type inverter comprises a switching element connected in series with said ripple power supply means as well as said induction heating coil means, a resonance capacitor connected in parallel with said switching element, and a diode connected in parallel with said switching element, and which further comprises drive means responsive to said start signal from said start signal generating means for withdrawing a drive voltage for rendering said switching element conductive.

14. An induction heating cooking apparatus in accordance with claim 13, which further comprises start signal transfer path means for transferring said start signal from said start signal generating means to said drive means, and wherein said output control means is adapted to act on said start signal transfer path means for defining a time period of said drive voltage from said drive means for defining the output of said self-excited oscillation circuit means.

15. An induction heating cooking apparatus in accordance with claim 14, wherein said output control means comprises time constant circuit means interposed between said start signal generating means and said drive means and responsive to said start signal for providing a voltage signal of a predetermined time period to said drive means, said drive means being responsive to said time period of said voltage signal obtained from said time constant circuit means for having defined the time period of said drive voltage.

16. An induction heating cooking apparatus in accordance with claim 15, which further comprises a heat sensitive device provided in the vicinity of said load for sensing the temperature of said load, said temperature control means including resistor means connected in series with said temperature sensitive device, reference potential source means, potential comparing means for comparing the potential at the junction of the series connection of said temperature sensitive device and said resistor means and the potential of said reference potential source means for providing an output when the potential at said junction of said series connection exceeds the potential of said reference potential source means, and temperature dependent oscillation stopping means responsive to the output of said potential comparing means for stopping the oscillation of said self-excited oscillation type inverter, and which further comprises variable resistor means, and variable resistor selecting switch means for selectively and switchably rendering said variable resistor means associated with any of said time constant circuit means and said resistor means, whereby said variable resistor means is adapted to be used both for said time control and for said output adjustment.

17. An induction heating cooking apparatus in accordance with claim 16, wherein said variable resistor selecting switch means comprises a first contact being connected to said time constant circuit means, a second contact connected to said resistor circuit means, and a third contact connected to one end of said variable resistor means and selectively switchable to said first contact or said second contact, said variable resistor selecting switch means being structured as a short circuiting type switch wherein said third contact is switched from one of said first and second contacts to the other of said first and second contacts after said third contact is once connected to both of said first and second contacts.

18. An induction heating cooking apparatus in accordance with claim 17, wherein said resistor means comprises a plurality of resistor elements having different resistance values provided in parallel, and which further comprises resistor element selecting switch means for selectively connecting said variable resistor means to any of said plurality of resistor elements in series when said variable resistor means is connected to said resistor means by means of said variable resistor selecting switch means.

19. An induction heating cooking apparatus in accordance with claim 18, wherein said variable resistor selecting switch means and said resistor element selecting switch means are structured to be switchable in a ganged fashion, and which further comprises a second resistor element, said second resistor element being connected to said resistor means by means of said resistor element selecting switch means when said variable resistor means is connected to said time constant circuit means by means of said variable resistor selecting switch means, whereby temperature control is made by said resistor means including said heat sensitive device and said second resistor element when said variable resistor selecting switch means is switched to said time constant circuit means.

20. An induction heating cooking apparatus in accordance with any one of the preceding claims 16 to 19, wherein said temperature dependent oscillation stopping means is responsive to the output of said potential comparing means to nullify said start signal from said start signal generating means.

* * * * *